US007252164B2

(12) United States Patent
Hossain et al.

(10) Patent No.: US 7,252,164 B2
(45) **Date of Patent: *Aug. 7, 2007**

(54) CUTTING STRUCTURE BASED HYDRAULICS

(75) Inventors: Syed Hossain, Spring, TX (US); James L. Larsen, Spring, TX (US); Dwayne P. Terracina, Spring, TX (US); Quan V. Nguyen, Houston, TX (US)

(73) Assignee: Smith International, Inc, Houston, TX (US)

( * ) Notice: Subject to any disclaimer, the term of this patent is extended or adjusted under 35 U.S.C. 154(b) by 300 days.

This patent is subject to a terminal disclaimer.

(21) Appl. No.: 10/816,542

(22) Filed: Apr. 1, 2004

(65) Prior Publication Data

US 2005/0217899 A1 Oct. 6, 2005

(51) Int. Cl.
*E21B 10/18* (2006.01)
*E21B 10/61* (2006.01)

(52) U.S. Cl. ..... 175/340; 175/339; 175/393

(58) Field of Classification Search ..... 175/339, 175/340, 393, 424; 239/271; 299/14
See application file for complete search history.

(56) References Cited

U.S. PATENT DOCUMENTS

| | | | | |
|---|---|---|---|---|
| 4,516,642 | A | 5/1985 | Childers et al. | |
| 5,096,005 | A * | 3/1992 | Ivie et al. | 175/340 |
| 5,934,389 | A | 8/1999 | Ramsey et al. | |
| 6,354,387 | B1 * | 3/2002 | Harris et al. | 175/340 |

FOREIGN PATENT DOCUMENTS

| | | | |
|---|---|---|---|
| GB | 2373522 | A | 9/2002 |

* cited by examiner

*Primary Examiner*—Jennifer H. Gay
*Assistant Examiner*—Matthew J. Smith
(74) *Attorney, Agent, or Firm*—Conley Rose, P.C.

(57) ABSTRACT

A drill bit configures hydraulic streams from the bit nozzles for the particular cutting structure to be cleaned based on the cutting structure location and geometry. The projected impingement location for each hydraulic stream projected fluid path is customized for a corresponding roller cone, with each nozzle or nozzle receptacle being individually positioned according to improve cone cleaning. At least two nozzles or nozzle receptacles should differ on the drill bit.

166 Claims, 14 Drawing Sheets

CUTTING STRUCTURE BASED HYDRAULICS

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

The invention generally relates to rotary cone rock bits. More particularly, the invention relates to rotary cone bits having nozzle arrangements to provide improved cutting structure cleaning.

Roller cone bits, variously referred to as rock bits or drill bits, are used in earth drilling applications. Typically, these are used in petroleum or mining operations where the cost of drilling is significantly affected by the rate that the drill bits penetrate the various types of subterranean formations. There is a continual effort to optimize the design of drill bits to more rapidly drill specific formations so as to reduce these drilling costs.

Rotary cone rock bits attach to sections of drilling pipe that connect together to form a drill string. A rock bit attaches to the end of this drill string and is rotated, drilling a bore hole into the earth. Rock fragments known as drill cuttings are generated at the bottom of the borehole by the cutting and grinding action of the drill bit rotating at the bottom of the bore hole. These rock fragments are carried uphole to the surface by a moving column of drilling fluid that travels to the interior of the drill bit through the center of an attached drill string, and is ejected from the face of the drill bit through a series of jet nozzles, and is carried uphole through an annulus formed by the outside of the drill string and the borehole wall. The drilling fluid also maintains borehole integrity, and cleans and cools the face of the rock bit.

A drill bit is configured with a number of roller cones, typically three, at its bottom that are equidistantly spaced around the circumference of the bit. A layout of a three-cone rock bit is shown in FIG. 1A. A rock bit 10 typically comprises a steel bit body and three cutter cones mounted on legs 14 extending from the bottom of the body. The cones are imbedded with inserts 26 (also described as cutting elements or teeth) that penetrate the formation as the drill bit rotates in the hole. It should is appreciated by those of ordinary skill in the art that there are some inserts or teeth on a roller cone that do not cut because they do not extend adequately from the cone surface. These may be identified by their substantially lower height. The upper end of the body is threaded (not shown) and serves as the pin for assembly of the rock bit onto a drill string for drilling bore holes. The area between the legs on the underside of the body is referred to as the dome 18. It should be noted that in describing the invention, an inventive drill bit may be described as though the central axis of the drill bit is vertical and words like "upper", "lower", "top", "bottom", "above", and "below" should be interpreted with this in mind, unless the context clearly indicates otherwise.

A cutter cone is rotatably mounted on each of the legs 14. A conventional internal structure may be used to mount the cutter cones on the legs. Each cutter cone has a hollow, generally conical steel body 20. The cones have an apex or nose 22 on one end and an opening on the other 24 for receipt of a journal. Each leg has a bearing journal (not shown) extending from it. Each cone is fitted over a journal, i.e., the journal is positioned inside the cone through the cone's opening. Ball bearings or other cone retention system (not shown) hold the cones on the journals. When mounted on the journals, the cones are radially oriented about the bit central axis so that the nose of the cones is closer to the axis than the opening of the cones.

Cutting elements 26, such as teeth or inserts, are pressed into holes or machined on the external surface of the cones. Unless noted otherwise, the terms teeth and inserts are used interchangeably herein. Cutting elements 26 provide the drilling action by engaging subterranean rock formation as the rock bit is rotated. The inserts may be any type or shape so long as they cut formation. For longer life, the inserts may be tipped with a super hard material (e.g. polycrystalline diamond).

The cutting elements are typically arranged in annular rows on the cone. Although nomenclature varies across the industry, the row that cuts the largest diameter within the bore of the hole is referred to as the gage row 28. The gage row cuts to about gage, i.e. the full diameter of the drill bit. The term "about" is used in this context because due to design or wear the inserts may cut slightly over or under gage but not to an extent that affects the action of the drill bit. For example, a gage row insert may extend a sixteenth of inch short of the gage diameter under certain situations and still be effective. The next cutting closest row is the row that is referred to as the drive (or off-gage) row 27. This row typically generates the highest torque on the cone. The row closest to the apex of the cone is referred to as the nose row 30. For cones comprising a single central cutting element on their apex, the nose row is the central cutting element.

The drawing of FIG. 1A is schematic in its illustration of the inserts. The inserts are illustrated on each cone in apparently overlapping positions. These inserts represent the inserts on all three of the cones projected around to the planes illustrated. This illustrates the complete coverage of the bore hole bottom by inserts during a complete revolution of the roller cones. In actuality, about ⅓ of the insert rows are on each cutter cone and the insert rows are arranged on the individual cones so that they do not interfere with rows of inserts on the adjacent cones.

The center jet of FIG. 1A can be used to illustrate the general construction of a nozzle. A jet assembly 32 is located in a nozzle receptacle bit body dome 18. In some drill bits, an outer sleeve 71 is welded into the dome of the bit body. The jet assembly preferably has a nozzle 34 with a shoulder that seats on a shoulder 72 in the sleeve and a jet bore axis (not shown). An inner retainer sleeve 66 is threaded into the outer sleeve for securing the jet against the shoulder. An O-ring 74 seals between the outer sleeve and the jet body to prevent washout around the jet body.

Generally, between each pair of cones is a nozzle receptacle with an installed erosion resistant nozzle that directs the fluid from the face of the bit to the hole bottom to move the cuttings from the proximity of the bit and up the annulus to the surface. The placement and directionality of the nozzle receptacles and nozzles, as well as the nozzle sizing and nozzle extension, significantly affect the rate of penetration for the drill bit and bit life.

Referring to FIG. 1B, nozzle positioning for a three cone rock bit is shown. In general, a three cone bit has three symmetrical legs, each with a journal. Each of the legs takes up a 120° section, with each of the three legs in a three cone rock bit being 120° apart. The journals, even though they have journal angle and offset associated with them, are also 120° apart, projected on a plane normal to the bit axis. For a two cone bit, the legs and journals can be apart by 180° or 165° or any other degree. The angular difference between the journal axes (at the leg centers) can be termed as the "phase angle" or phase angle difference. Journal axes 102, 104, 106 are each offset radially from bit central axis 108 by a distance defined by a circle 110. By virtue of even spacing around the drill bit, each of the three journal axes are spaced 120 degrees from its neighbors. Three nozzle receptacle locations are shown: nozzle-1 112, nozzle-2 114, and nozzle-3 116. Each nozzle receptacle 112, 114, 116 is located midway between the adjacent journal axes 102, 104, 106. This results in a 120 degree spacing between the nozzle receptacles.

The amount of energy available at the bit is generally dictated by factors external to the bit such as the drilling rigs' available hydraulic energy, drill pipe type, bottom hole assembly (BHA) configuration and drill depth. However, once the available energy for the rock bit is determined, properly configuring the hydraulics of the bit for the specific application can significantly affect the rate of penetration (ROP) of the bit in the formation.

The optimal placement, directionality and sizing of each nozzle can change depending on the bit size and formation type that is being drilled. For instance, at the very soft end of the formation spectrum there is a strong tendency for clay minerals to adhere to the teeth or inserts of bits. The adhesion of formation to teeth or inserts is commonly referred to as "bit balling". As is known in the art, bit balling describes the packing of formation between the cones and bit body, or between the bit cutting elements, while cutting formation. When it occurs, the cutting elements are packed off so much that they don't penetrate into the formation effectively, tending to slow the rate of penetration for the drill bit (ROP). For example, "gumbo" in the US Gulf Coast area has a sticky nature and adheres to rock bit cutting structures. It must be removed efficiently to maintain reasonable penetration rates.

In harder clays and shales, cuttings can become impacted or "balled up" between the teeth or inserts of the cutting structures. When formation sticks to cones or is impacted between cutting elements it limits insert/tooth penetration. Also, formation packed against the cone-shell closes the flow channels needed to carry other cuttings away. This promotes premature bit wear. In either instance, fluid directed toward the cones can help to clean the inserts and cones, allowing them to penetrate to a greater depth, maintaining the rate of penetration for the bit. Furthermore, as the inserts begin to wear down, the bit can drill longer since the cleaned inserts will continue to penetrate the formation even in their reduced state.

In part to combat bit balling, and in part to allow for larger cones, the cutting elements on different rolling cones often are designed to intermesh. Intermeshing reduces bit balling. As a cutting element of one cone intermeshes between the cutting elements of another cone, it dislodges balling between the cutting elements. Having the cutting elements intermesh also allows the diameter of the cones to be larger, providing for a larger bearing surface which results in a more durable cone. One aspect of intermeshing is different spacing between various rows of inserts on the cones. Of particular interest, the spacing of the gage row and drive row vary amongst each of the roller cones.

FIG. 2A is a bottom view of a hypothetical three cone rock bit (not to scale). First nozzle receptacle 102, second nozzle receptacle 104, and third nozzle receptacle 106 are located between three roller cones 108, 110, and 112. Fluid columns 114, 116, 118 can be seen projecting from respective nozzle receptacles. Although it is to be understood that the jet of fluid ejected from each nozzle receptacle behaves in a complicated manner, to simplify understanding of the invention each fluid discharge is depicted as a column to emphasize its direction. It should also be noted that a revolved surface can be seen around each row of cutting elements rather than the individual cutting elements themselves.

FIGS. 2B–2E (not to scale) show the relative positions of the fluid columns to the roller cones. FIG. 2B shows nozzle fluid stream 118 in proximity to cone 112. Also shown is gage row 202 and drive row 204. FIG. 2C shows nozzle fluid stream 116 in proximity to cone 110. Also shown is gage row 206 and drive row 208. FIG. 2D shows nozzle fluid stream 114 in proximity to cone 108. Also shown is gage row 210 and drive row 212. FIG. 2E shows a composite view of FIGS. 2B–2D. It can be seen that the three fluid streams, 114, 116, 118, appear identically located when superimposed with respect to each fluid stream's respective roller cone. Each fluid stream is about the same distance from the gage rows (or more precisely, the surface of revolution for the gage row inserts) 202, 206, 210 on the respective roller cone. It can be seen that the spacings from the inserts on other rows 204, 208, 212 on the roller cones to the corresponding fluid stream varies significantly from cone to cone, however.

Numerous efforts have been made by drill bit designers to solve the problem of bit balling yet the problem persists. Known drill bit designs vary placements, directionality and sizing of nozzles and fluid streams in an attempt to maximize performance and rate of penetration of drill bits in various formations. However, the type, angle placement and specifics of nozzle receptacles for any given bit are the same. This may be due to the manner in which drill bits are typically manufactured. Typically, a drill bit is assembled from three identical portions. These portions are welded together to form the drill bit body. The roller cones are then attached to the bottom of the bit body. Further, perhaps to avoid installation problems at the drilling site, the nozzles installed in each nozzle receptacle are typically identical. However, while the relative location of the nozzle receptacles and nozzles may therefore be the same, the roller cones on the bit bottom are not. The spacing of the rows of inserts on each roller cone differs from the spacing of the rows of inserts on its neighboring cones because of intermeshing. As a result, in a three cone rock bit, the conventional hydraulic configuration either cleans one cone very well and compromises cleaning of the others, or a less-than-optimum configuration exists to clean cutting structures on all three cones.

Bit balling remains a problem. Ideally, a drill bit could be designed that reduces the effects of bit balling while drilling the borehole. In at least some embodiments, this drill bit would not require complicated installation of varying, differently sized, or differently configured nozzles at the drill site.

BRIEF DESCRIPTION OF THE DRAWINGS

For a more detailed description of the preferred embodiment of the present invention, reference will now be made to the accompanying drawings, wherein.

DETAILED DESCRIPTION OF THE PREFERRED EMBODIMENT

A drill bit built in accordance with the principles of the invention may include two or more peripheral (i.e. non-central) bit cleaning nozzles. Non-central refers to the exit centroid (either of the nozzle receptacle or the nozzle, depending upon the embodiment) being at a location from 25% to 100% of the drill bit radius as measured from the central axis of the drill bit. Three bit cleaning nozzles may be advantageously positioned on the dome of a three-cone bit (possibly in addition to other nozzles), such that the bit cleaning nozzles each direct a fluid column between two cones. The invention proposes bringing the energy of each fluid column to close proximity to a row of cutting elements of interest for each roller cone. A three-cone drill bit according to an embodiment of the invention includes bit cleaning nozzles between each pair of roller cones, each angled or placed differently from the other or others to improve cone cleaning and the rate of penetration for the drill bit. A preferred embodiment includes differently placed or angled bit cleaning nozzle receptacles on the drill bit.

Given that most cutting structures vary from cone to cone, the most ideal situation is to configure each hydraulic stream for each particular cutting structure to be cleaned. This invention claims the ability to have two or more different hydraulic configurations on a single bit where the configurations are based on cutting structure location and geometry to provide improved bit performance. The key concept is that the nozzle location and orientation are to be individually selected depending upon the layout of the rows of cutting elements, i.e. dependent upon the positions of the insert rows such that each projected fluid path is directed to improve or maximize cone cleaning where cones of differing construction are being used, as with intermeshing cones. In some embodiments, the fluid columns from the nozzles all come within 0.4 inches of a row of interest on the cone. It is believed, however, that previous designs did not fully feature close fluid proximity of drilling fluid to the tips of the inserts. Improved cone cleaning and rate of penetration will be achieved, it is believed, when the projected fluid path comes within 0.2 inches of the tips for the cutting elements on the same row of interest for each cone. It is not necessary for the distances between the various fluid paths and their corresponding rows to be identical, however.

Figure 1A:
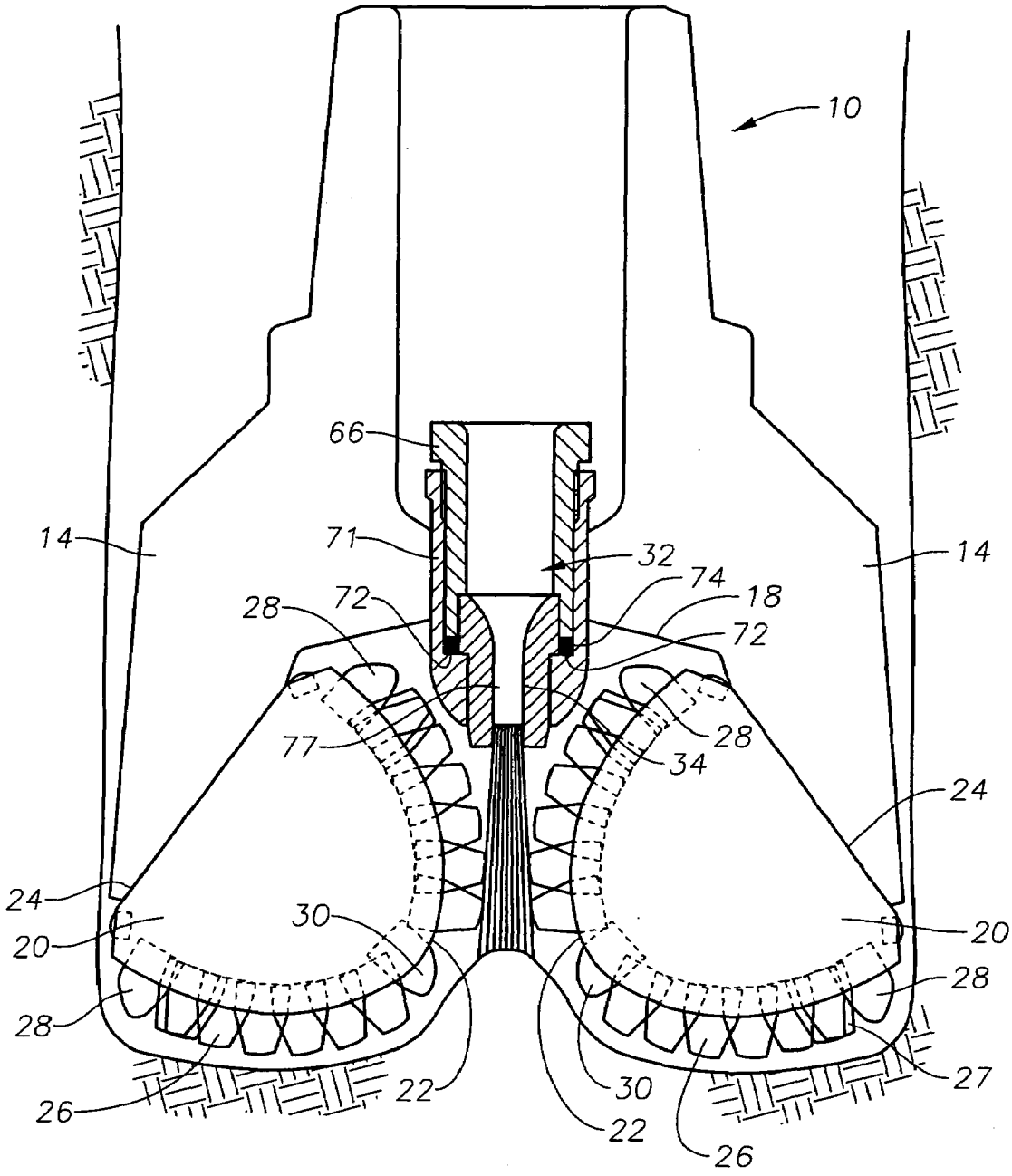
FIG. 1A is a cut-away view of a drill bit.
Figure 1B:
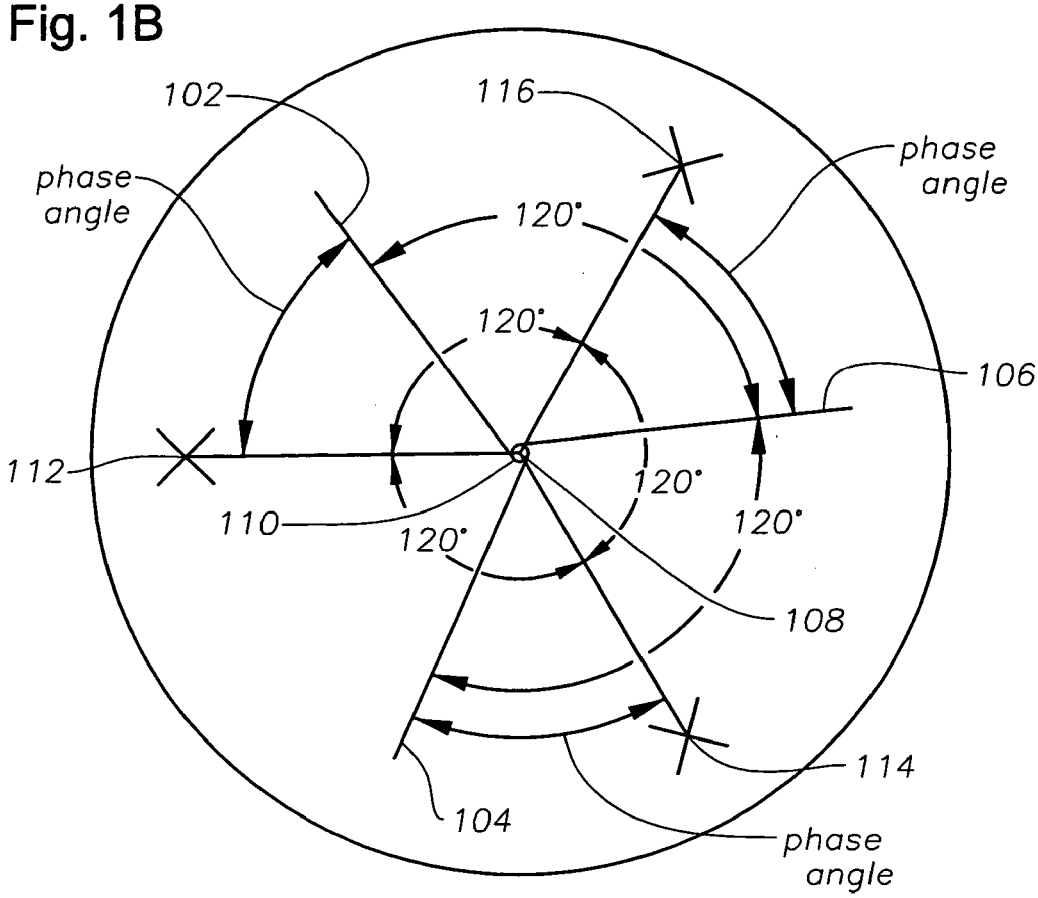
FIG. 1B is a layout design for the locations of journal axes and nozzle receptacles in a conventional drill bit design.
Figure 2A:
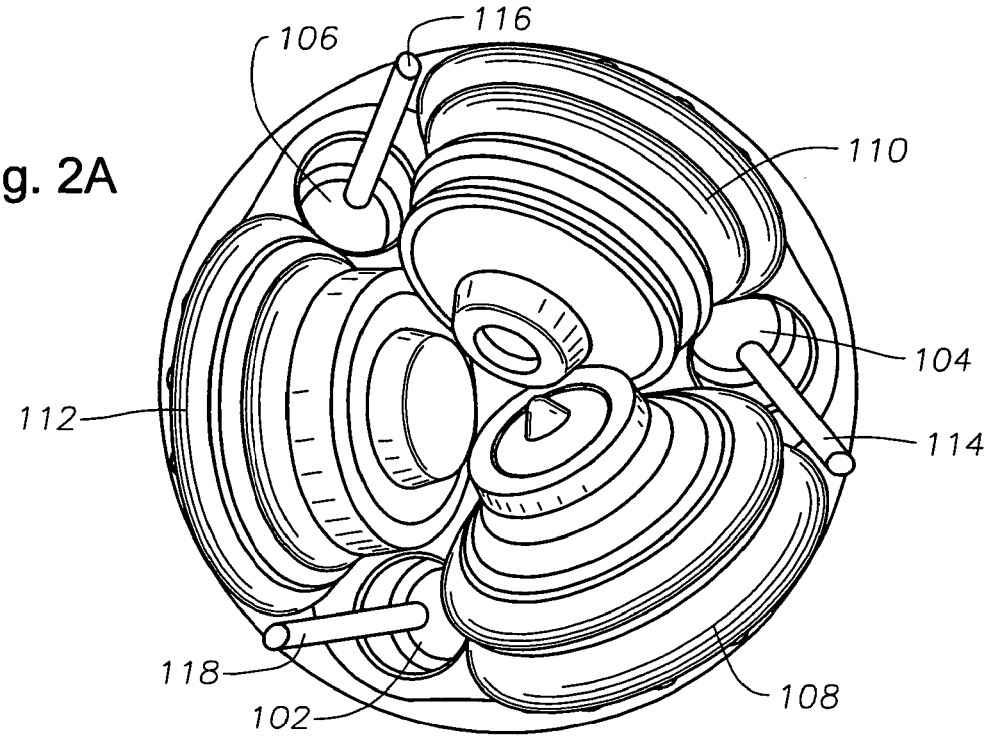
FIGS. 2A–2E are views of a hypothetical drill bit design showing the relative locations of fluid streams to their respective roller cones.
Figure 2B:
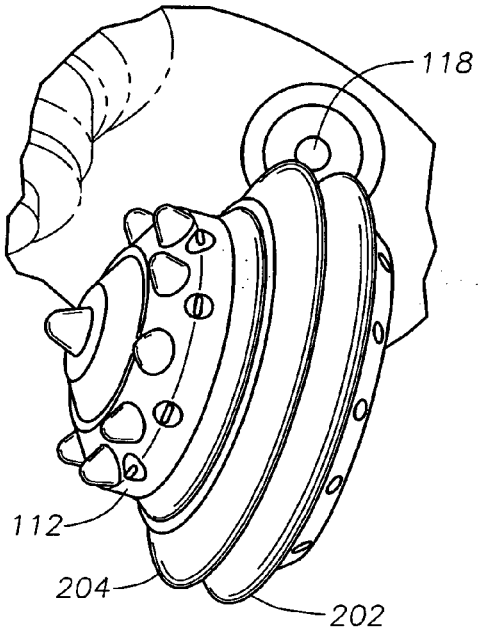
Figure 2C:
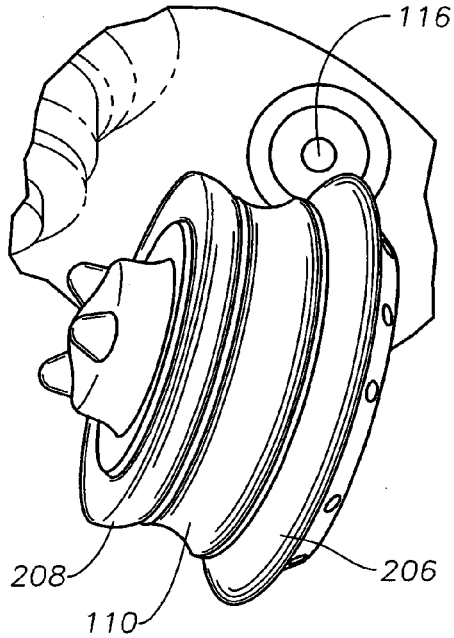
Figure 2D:
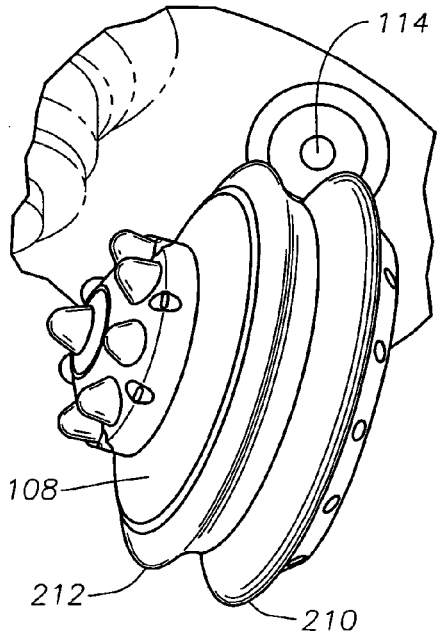
Figure 2E:
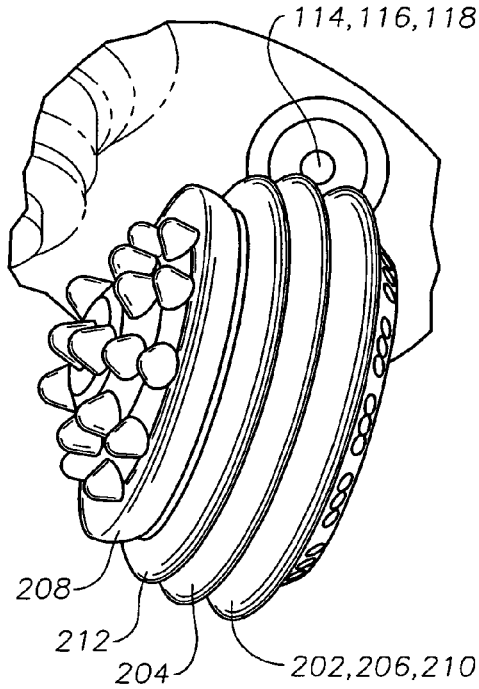
Figure 3A:
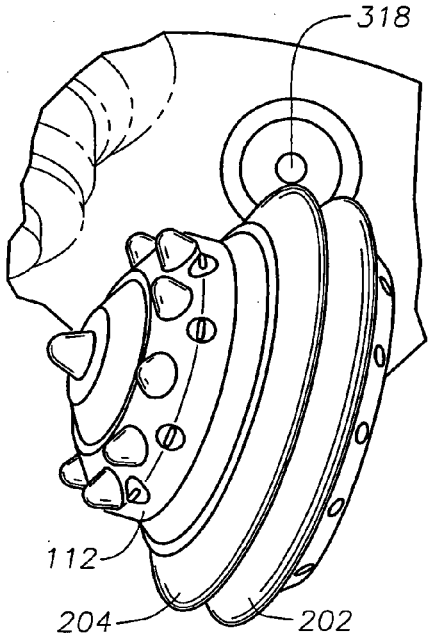
FIGS. 3A–3D are views of one embodiment of a drill bit according to the invention showing relative locations of fluid streams to their respective roller cones.
Figure 3B:
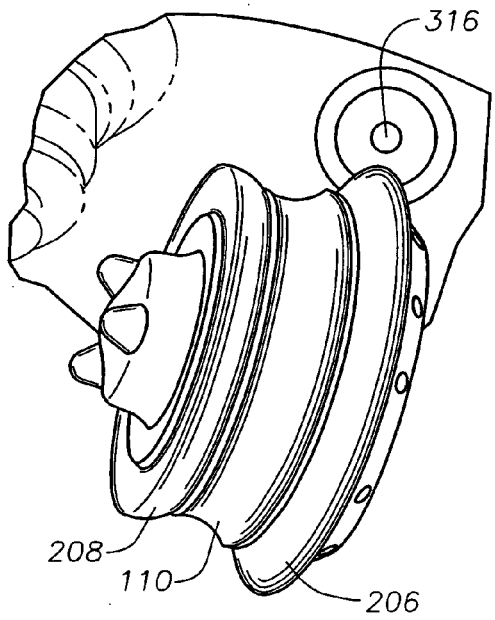
Figure 3C:
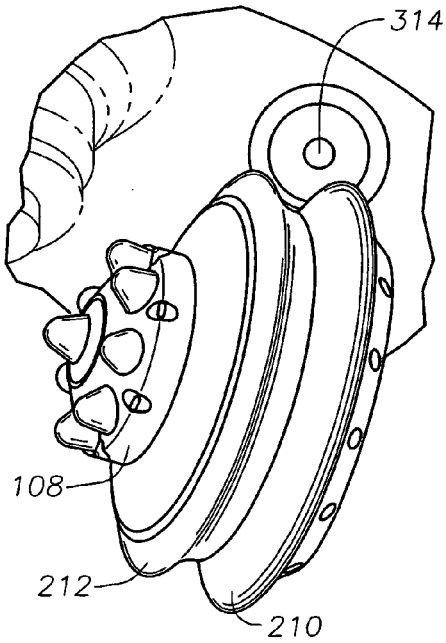
Figure 3D:
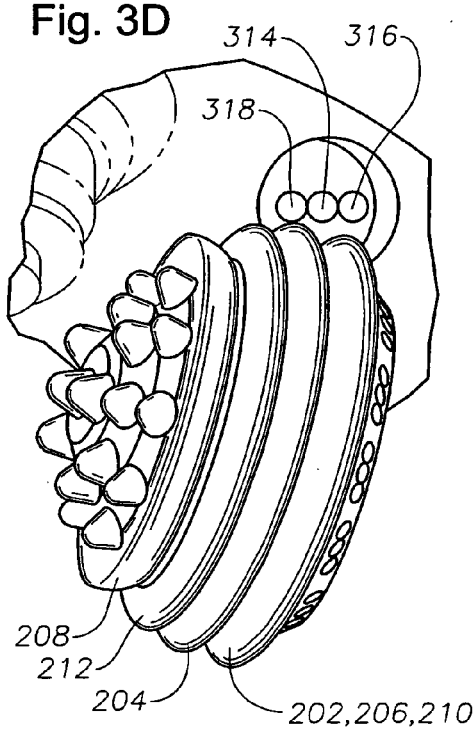

A primary objective of the invention is to achieve close proximity of the column of drilling fluid to the inserts on each cone, despite differences in the layout of the cutting elements on each cone. FIG. 3A shows nozzle fluid stream 318 in proximity to cone 112. Also shown is gage row 202 and drive row 204. FIG. 3B shows nozzle fluid stream 316 in proximity to cone 110. Also shown is gage row 206 and drive row 208. FIG. 3C shows nozzle fluid stream 314 in close proximity to cone 108. Also shown is gage row 210 and drive row 212. FIG. 3D shows a composite view of FIGS. 3A–3C. Unlike the design of FIG. 2E, the three fluid streams, 314, 316, 318, are very differently located when superimposed with respect to each fluid stream's respective roller cone. The drill bit has been designed so that each fluid stream comes within 0.4 inches of the line of revolution defined by the cutting tips of the cutting elements. It is believed that the most effective cone cleaning will occur when the fluid streams are within 0.2 inches of this line. Further, in each Figure, the projected fluid path lies between the gage and drive cutting rows. This is believed to result in a drill bit design that is highly efficient at cleaning the cutting structure.

The differences in the fluid paths can be based on one or a combination of the location of the nozzle receptacle on the dome of the bit body, on the lateral and radial angles of the projected fluid path as it exits the nozzle, or on the distance from a nozzle exit to a given plane perpendicular to the bit central axis (such as the distance from the dome of the drill bit). However, it should be noted that it is particularly advantageous to achieve the desired location of the projected fluid path by varying the nozzle receptacle location on the drill bit from the conventional locations, rather than use of nozzles of different designs; this allows identical nozzles to be installed at the drilling site, simplifying installation and reducing chances of error.

The row or rows of interest for the invention are generally on or near the outer portion of the cone, but does not necessarily need to be the gage row. The projected fluid path is preferably aimed between the gage row inserts or the next inner cutting row (referred to as the off-gage or drive row) inserts, ideally just inside the gage diameter at the bottom hole. The gage row tends to work the hardest and need to be cleaned and cooled more than other rows of inserts. If the gage row and the drive row are close to each other or overlapping (by being staggered), the ideal impingement location would be the space between the two rows at a distance of 0.2 inches or less to the tips of one insert row or the other, preferably the gage row. If the gap between the gage row and the drive row is large (the gage row stands apart from the inner rows), the ideal impingement location would be the tip of the gage row inserts. It should be noted, however, that any inner row of inserts can be cleaned rather than the gage row and it remains within the scope of the broader embodiments of the invention. Further, enhanced performance through more effective cone cleaning may result if the projected fluid path passes close to more than one row of inserts, although this is not crucial to the invention in its broader forms.

One way to affect the proximity of a projected fluid path to the rows of cutting elements on the roller cones is by changing the relative locations of the nozzle receptacles. As the cones rotate on the journal axis, the journal axis can be a convenient reference for geometric positions of the nozzle bore centroid; another reference is the bit axis. The following explanation assumes that the centroid of the nozzle and of the nozzle receptacle are the same from the perspective of FIG. 4. This is equivalent to assuming that a straight nozzle with a vertical fluid projection (such as a standard nozzle) is being used.

Figure 4:
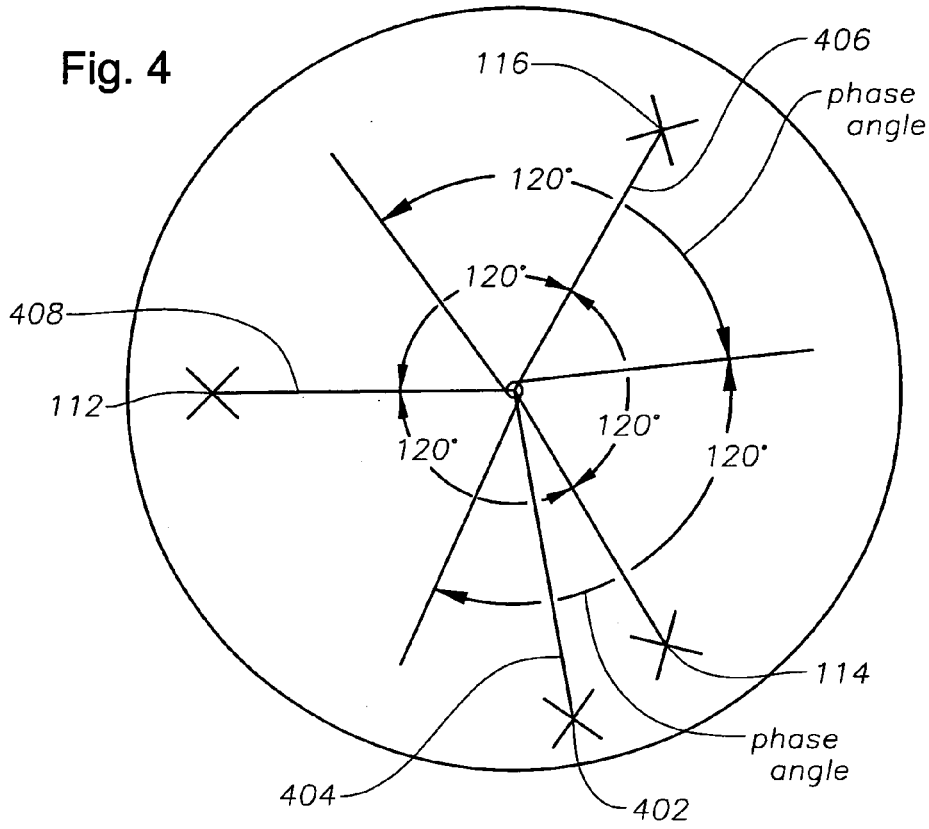
FIG. 4 is a layout design for locations of journal axes and nozzle receptacles in an embodiment of the invention.

Referring to FIG. 4, locations 112, 114, and 116 are shown for the traditional locations for a nozzle receptacle. Alternate location for nozzle 114 is shown as nozzle receptacle location 402. A line 404 between a nozzle bore exit point (centroid) 402 and the bit axis may be drawn from the bit axis on a horizontal plane (normal to the bit axis) through the first nozzle exit point 402. Another line 406 is also drawn in a similar manner through a second nozzle exit point 116. If the first and second nozzle exit points coincide about the bit axis by the same "phase angle" defined by their respective journal axes, then the two nozzle locations are said to be identical in relation to their corresponding journal axes, and hence to the cone shell of the respective roller cone. If the two nozzle exit points do not coincide when rotated by the phase angle, as would be true with respect to nozzle receptacle locations 402 and 116 in FIG. 4, the nozzle locations are said to be at different angles with respect to their respective journal axes.

The location of a projected fluid path may also be affected by a change in the radial location of the nozzle receptacles. Referring to FIG. 4, a distance from first nozzle exit point 402 to the bit central axis is defined by line 404. A second distance, for nozzle exit point 116, is defined by line 406. A third distance from the bit central axis is defined by line 408 to nozzle exit point 112. If any of these lengths for these lines differs from any other, then the radial location of these nozzle receptacles are said to be different from one another.

The proximity of the drilling fluid column to the cutting elements can thus be achieved by moving the nozzle receptacle locations only, with only a vertical nozzle being used (i.e. without lateral or radial angles for the projected fluid path generated by the nozzle alone). Each of the nozzle receptacle locations can be moved in such manner that each of the projected fluid paths is within 0.40 inches, 0.30 inches, or 0.20 inches of the corresponding point of interest on a row of cutting elements, with at least one of the nozzle receptacle positions being different from at least one of the other nozzle receptacle locations.

In addition to, or in lieu of, modifying the placement of the nozzle receptacles, the projected fluid path from each nozzle may be tilted by some combination of a lateral angle, a radial angle, or both. This may be accomplished by an angled nozzle receptacle or by a nozzle generating an angled projected fluid path.

Figure 6A:
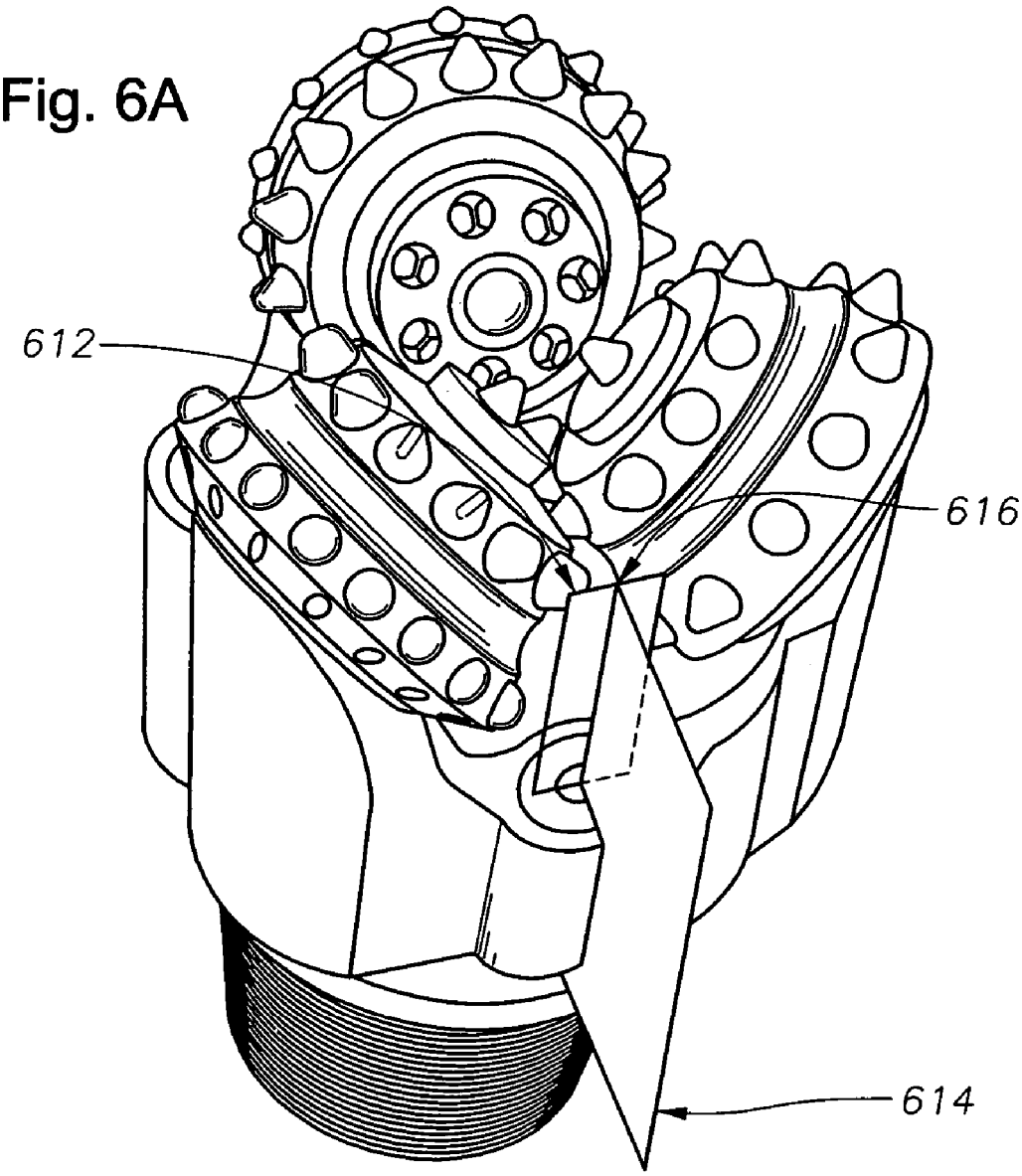
FIGS. 6A–6E illustrate drill bits with reference planes to define lateral and radial angles.

FIG. 6A helps to define these lateral and radial angles. Referring to FIG. 6A, a three-cone rock bit is shown having two planes, a radial reference plane 612 and a lateral reference plane 614 intersecting 616 on bit body dome 18. Lateral reference plane 614 and radial reference plane 612 are normal to each other and each lies parallel to the bit centerline. The lateral angle is the projected fluid path to lateral reference plane 614. The radial angle is the projected fluid path to radial reference plane 612. In the case of a nozzle that generates an angled flow, for example, the proximity of the projected fluid path to the cone inserts may be affected by the exit location of the nozzle (nozzle centroid) relative to a plane perpendicular to bit central axis (such as the distance from the dome of the drill bit). In other words, if the starting point of the angled flow changes, including "vertically", it will change where the fluid is directed. Thus, this reference is another relevant variable.

The requirement that the inserts be cleaned dictates definition of a maximum clearance distance from a projected fluid path to a location defined by a specific location on the cone inserts. This clearance distance determines the effectiveness of the nozzle system's ability to clean the inserts.

It is preferred that all of the cone cleaning projected fluid paths on the drill bit come within the maximum distance prescribed in any given embodiment to the cutting tips of the inserts. In another embodiment of the invention, every projected fluid path near the cones comes within 0.4 inches of the same row (e.g. gage row).

To understand the cleaning action that occurs downhole, a set of reference terms should be established. The degree of cone cleaning (as well as the risk of cone shell erosion) generally corresponds to the distance between a point relative to the roller cones on the drill bit and a point or area of the jet of drilling fluid ejected from the nozzle. With regard to the roller cones, the measurement location on the roller cone of particular interest is a closest point attained by tips (as hereafter defined) of the cutting elements on the row of interest. The measurement location of interest on the fluid jet is a projected fluid path for the fluid.

Figure 5A:
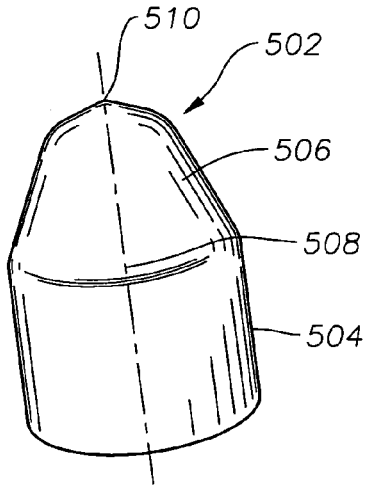
FIGS. 5A–5D are views of an insert and roller cone defining an insert tip.

Cutting elements on a roller cone rock bit come in a variety of types, shapes, and sizes. For a cutting element that is an insert, the tip of the insert is the location of interest on the insert. The tip of an insert is defined as the intersection point between the axis of the insert (of the cylindrical portion) and the cutting surface of the insert. For example, referring to FIG. 5A, an insert cutting element 502 is shown. Insert 502 includes a cylindrical base 504 and sloped region 506. Insert axis 508 is defined as the axis of the cylindrical base. The insert tip 510 is located as the intersection of the insert axis 508 and the surface of the insert 502. The tip may not necessarily be at the highest point on the insert cutting surface away from the cone. In the event that an insert has a non-cylindrical base, the centroid of the base may be used to establish the location of the axis of the insert.

Figure 5B:
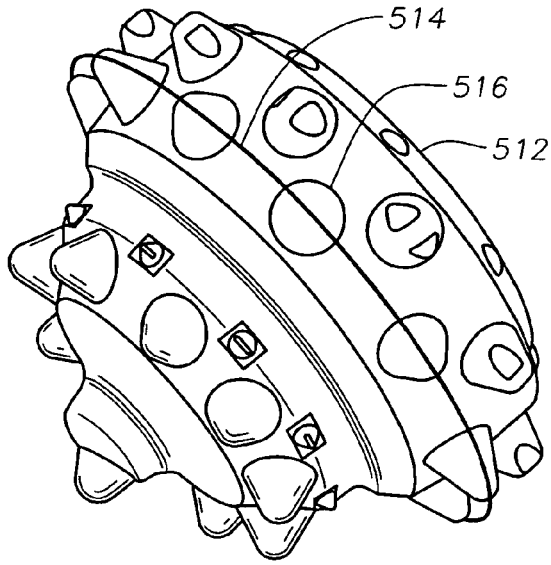

Referring to FIG. 5B, a roller cone 512 with rows of cutting inserts is shown. Insert tip curve 514 drawn from insert 516 is also shown. The insert tip curve for a particular row of inserts on a cone is defined as the circular curve formed by joining all the insert tip points of that particular row. The curve can also be generated by revolving any insert tip point on a row of inserts about the corresponding cone (journal) axis.

Figure 5C:
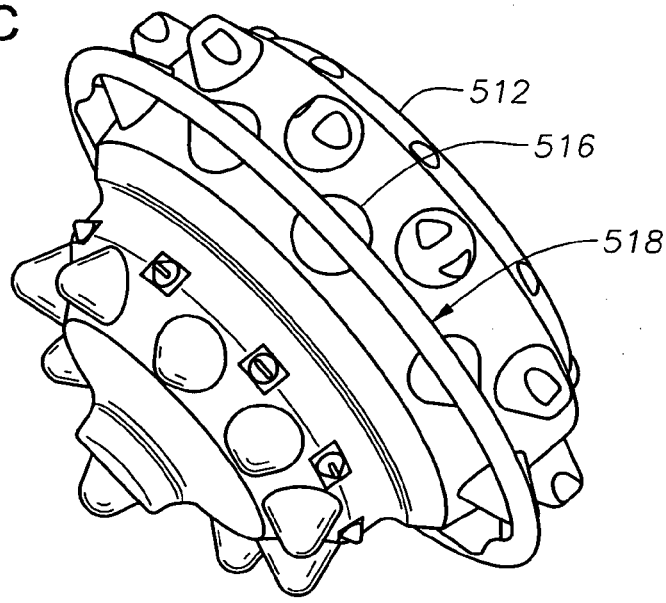
Figure 5D:
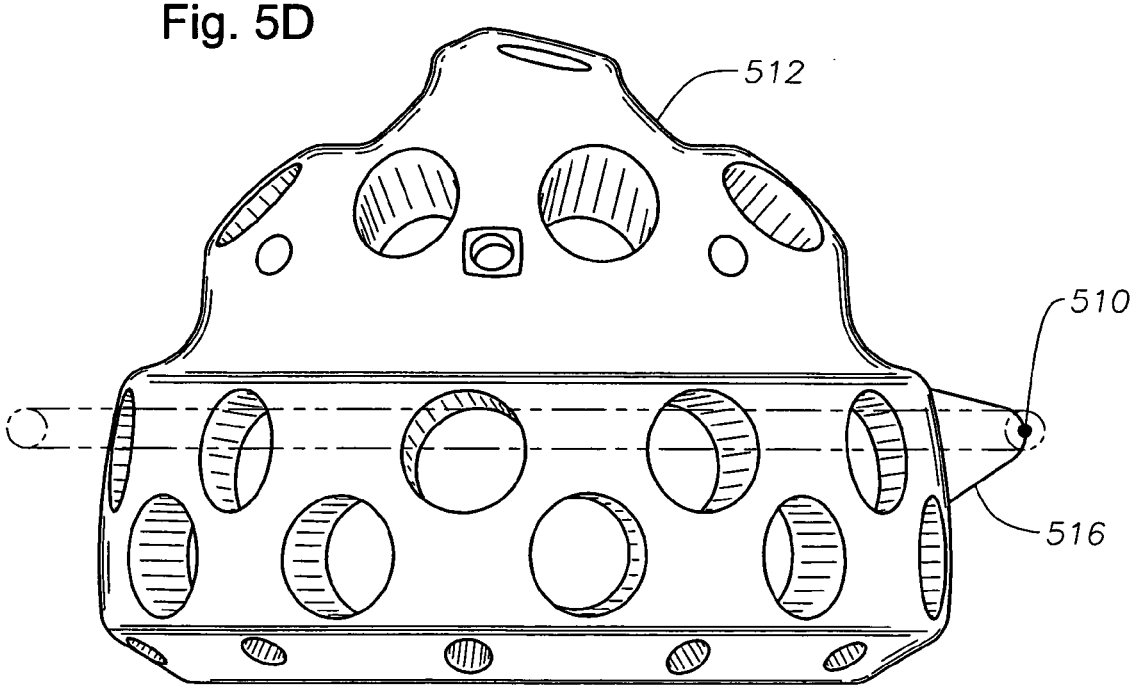

FIGS. 5C and 5D show different perspectives of roller cone 512 with insert 516. A torroid surface 518 of the desired radius may be created by revolving a circle around the cone axis, the center of the circle being on the insert tip point 510.

Figure 5E:
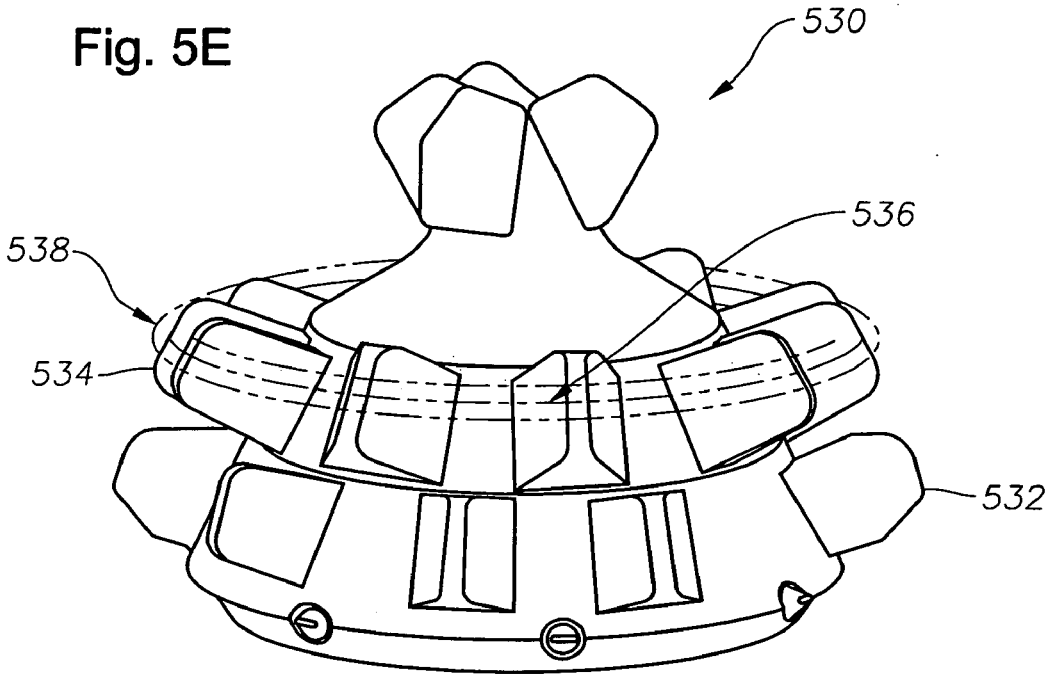
FIGS. 5E–5F are views of a milltooth and roller cone defining a tip for a cutting tooth.
Figure 5F:
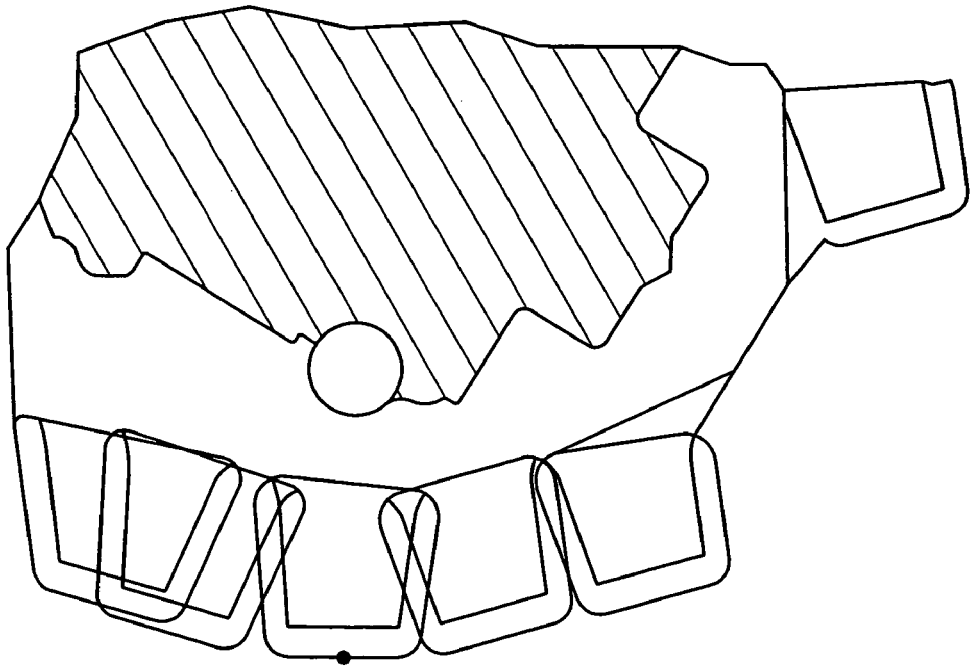

FIG. 5E shows a roller cone 530 with milled teeth 532 as the cutting elements. The cutting row including tooth 534 is selected as the row of interest, with the tooth tip curve 536 and torroid surface 538 identified. FIG. 5F shows all three cones of a milltooth 3-cone bit in rotated profile. The cutting teeth on a milltooth bit are machined out of a cone forging and do not have a cylindrical base. The teeth also have hardfacing coating over the protruded segments. The tooth tip point for a tooth is defined as the mid-point of the hardfacing tip section that is farthest away from the cone surface. The tooth tip curve definition is defined the same way as for inserts, described above.

Referring back to FIG. 5C, the distance of interest between a projected fluid path and a row of inserts is defined as the distance between the insert tip curve and the projected fluid path. One way of interpreting this would be to require that the projected fluid path intersect a torroid surface formed by revolving a circle around the cone axis. Preferably, this is true for all the cones on the rock bit, i.e. all three cones on a three cone rock bit.

It is preferable that the same row is targeted on all the cones of the rock bit. It is expected that the most optimized cone cleaning would result when the projected fluid path is within 0.2 inches of the insert tips on the same row on each cone. In this way, only one row of inserts (the one that needs cleaning most) is impinged upon by a projected fluid path. Nonetheless, it may be found in certain applications that it is desirable to have the projected fluid path within 0.2 inches of different cutting rows. As used herein, when referring to the same row for multiple cones, reference is being made to the same relative row on the cones. For example, reference to a distance to the gage row for all of the projected fluid paths refers to the distance between any given projected fluid path and the gage row on the closest one of the roller cones. Similarly, shorthand reference may be made to the off-gage row for each of the cones by simply referring to the off-gage row.

Figure 7:
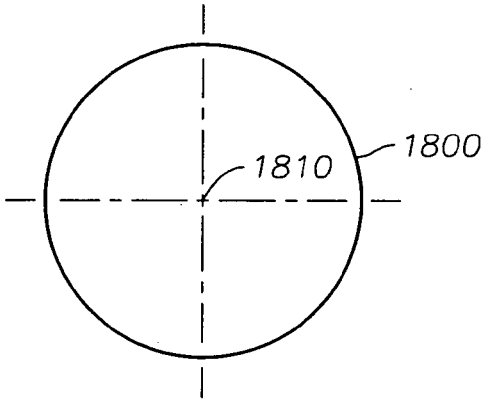
FIG. 7 shows a first projected fluid path.
Figure 8:
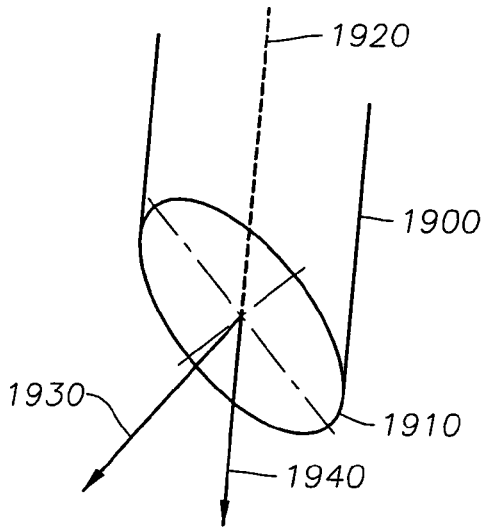
FIG. 8 shows a second projected fluid path.

It is to be understood that the jet of fluid ejected from each nozzle receptacle behaves in a complicated manner, but the geometric parameter called the "projected fluid path" that generally indicates the expected direction of fluid projection may be found in one of three ways. First, the "face normal projected fluid path" is a line projected normal to the exit surface of an exit port to the nozzle. For example, as shown in FIG. 7, if a vertical nozzle has a circular exit port 1800, the centroid 1810 of the circle defined by the exit port is the center of the circle. The projected fluid path for this calculation would be a line perpendicular to the center of this circle (i.e. coming straight out of the page), regardless of the angle at which this circle is disposed to the longitudinal axis of the nozzle. For example, FIG. 8 shows a nozzle 1900 with an exit port 1910 disposed at an angle relative to the nozzle. The face normal projected fluid path 1930 is perpendicular to the angular face of the exit port. In the case of an oval-shaped exit port for the nozzle, the centroid of the oval is its center. For more complex exit area shapes, the centroid can be calculated mathematically by equating moments of area or through the use of a CAD (computer aided design) system.

A second way to determine the projected fluid path is the "parallel to nozzle centerline projected fluid path". This is a line projected from the centroid of the nozzle exit plane parallel to the centerline of the nozzle. For this calculation, a line projects from the centroid of the exit surface of the nozzle in a direction parallel to the nozzle axis centerline. Obviously, where a straight nozzle is disposed at a near-vertical angle, with the exit plane of the nozzle being perpendicular to the fluid flow (as is typical), these two projected fluid paths are the same. For the geometry shown in FIG. 7 the parallel to nozzle centerline projected fluid path is the same as the face normal projected fluid path. In FIG. 8, the parallel to centerline projected fluid path 1940 is different from the face normal projected fluid path 1930. Whether the "face normal projected fluid path" or the "parallel to nozzle centerline projected fluid path" is the appropriate method to approximate the fluid jet depends upon factors such as the construction of the fluid nozzle.

A third way to determine a projected fluid flow path is both the most accurate and the most complicated. Termed the "projected average fluid path", it takes into account the fluid behavior in order to determine directionality. To accomplish this task, some knowledge of the flow field is required through means such as computational fluid dynamics (CFD) and/or experimentation. Experimental methods for obtaining flow field data include laser velocimetery, probes, visual observation or other techniques. Typically however, these methods are usually quite expensive and time consuming. CFD, on the other hand, is particularly well suited for this type of analysis since direction and speed of the fluid can be readily determined within discrete elements in the flow field. For instance, the directionality of fluid at a nozzle exit can be determined by evaluating each element or sub-element (a face or node) of the fluid at the exit plane or exit surface of the nozzle. The first step is to combine all the directionality information of each individual element or sub-element of the nozzle exit into a form that is representative of all the fluid flowing through the nozzle exit. Known approaches include the basic arithmetic average to more complex calculations such as area-weighted averages, velocity-weighted averages, mass-weighted averages, and location-weighted averages. While each method provides an "average velocity vector" result, the nature of the flow field and how the flow field data was generated, may have significant effect on the similarity of the final results. To this end, the preferred method of calculation is by the mass-weighted average velocity vector, $\vec{V}_{AVG}$, as shown below.

$$\vec{V}_{AVG} = \frac{\int \vec{V}_{\rho}\vec{V}\cdot d\vec{A}}{\int \rho\vec{V}\cdot d\vec{A}} = \frac{\sum_{i=1}^{n}\vec{V}_i\rho_i\vec{V}_i\cdot d\vec{A}_i}{\sum_{i=1}^{n}\rho_i\vec{V}_i\cdot d\vec{A}_i} \tag{1}$$

where, $\vec{V}_{AVG}$=Mass-weighted average velocity vector of the fluid flowing through the nozzle exit.

$\vec{V}$=Fluid velocity vector at an arbitrary location on the nozzle exit surface.

$d\vec{A}$=Elemental area of the nozzle exit surface at the arbitrary location.

ρ=Density of the fluid.

i=Subscript denoting element number, ranges from 1 to n.

n=Total number of elements on nozzle exit surface.

$\vec{V}_i$=Velocity vector at element i.

$\rho_i$=Fluid density at element i.

$d\vec{A}_i$=Surface area of element i.

The fluid directionality is then defined as the unit vector of the average velocity vector. It is calculated by dividing the average velocity vector by its magnitude. To measure the angle between the average velocity unit vector and bit centerline, a unit vector describing the bit centerline should be calculated. Customarily, it is assumed that the positive direction of one coordinate axes in a Cartesian system follows the bit centerline towards the hole bottom. Hence, the bit centerline unit vector lies on one of the principal axis. However, it is not mandatory to do so. Thus the unit vector of the average velocity vector is defined as $$\hat{u}_{AVG} = \frac{\vec{V}_{AVG}}{\|\vec{V}_{AVG}\|} \tag{2}$$

and the bit centerline unit vector is defined as $\hat{u}_{CL}$

Where, $\hat{u}_{AVG}$=Unit vector of the mass-weighted average velocity vector of fluid flowing through the nozzle exit.

$\hat{u}_{CL}$=Unit vector describing the bit centerline directed towards the hole bottom.

A vector analysis "dot product" can then be performed on the two unit vectors to determine the angle between the bit centerline and the average velocity vector.

$$\theta=\cos^{-1}(\hat{u}_{AVG}\cdot\hat{u}_{CL}) \quad (3)$$

Where,

θ=Angle between the bit centerline unit vector, $\hat{u}_{CL}$, and the average velocity unit vector, $\hat{u}_{AVG}$.

Using this information, the preferred projected average fluid path is defined in this case by projecting the geometric centroid of the nozzle exit surface in a direction defined by the unit vector of the mass-weighted average velocity vector. Alternatively, the mass flow centroid can also be used as a starting point. It would be calculated in similar fashion as the geometric centroid, except the mass flow rate would be used as the basis to determine the centroid location instead of the physical exit area. The possible scenarios for vertical flow include: 1) both projected fluid paths and projected average fluid paths are parallel to bit centerline; 2) face-normal projected fluid path is not parallel to bit centerline, but average fluid path is parallel to bit centerline; and 3) face-normal projected fluid path is not parallel to bit centerline, average fluid path is not parallel to bit centerline, but at least a portion of the fluid is directed in such a way to provide vertical flow. The first instance of vertical flow might be accomplished by attaching a standard mini-extended nozzle to the drill bit body. The second instance of vertical flow might be accomplished by attaching a standard mini-extended nozzle with an exit port truncated to the interior passage of the drill bit rather than perpendicular to the interior passage. The third instance of vertical flow might be accomplished by a lobed or multi-orifice nozzle.

In addition, the shape of the discharge port may vary. For example, the discharge port may be a circle, an oval, an ellipse, a slit, a horseshoe shape, or any other suitable shape. For unusual shapes of the discharge port, determination of a centerpoint for the fluid column may be made by determining the centroid of the discharge port and projecting it along an axis created by the exit flow angle by methods known to one of ordinary skill in the art. Measurement from the insert tip curve to the fluid column centroid may then be made.

Figure 6B:
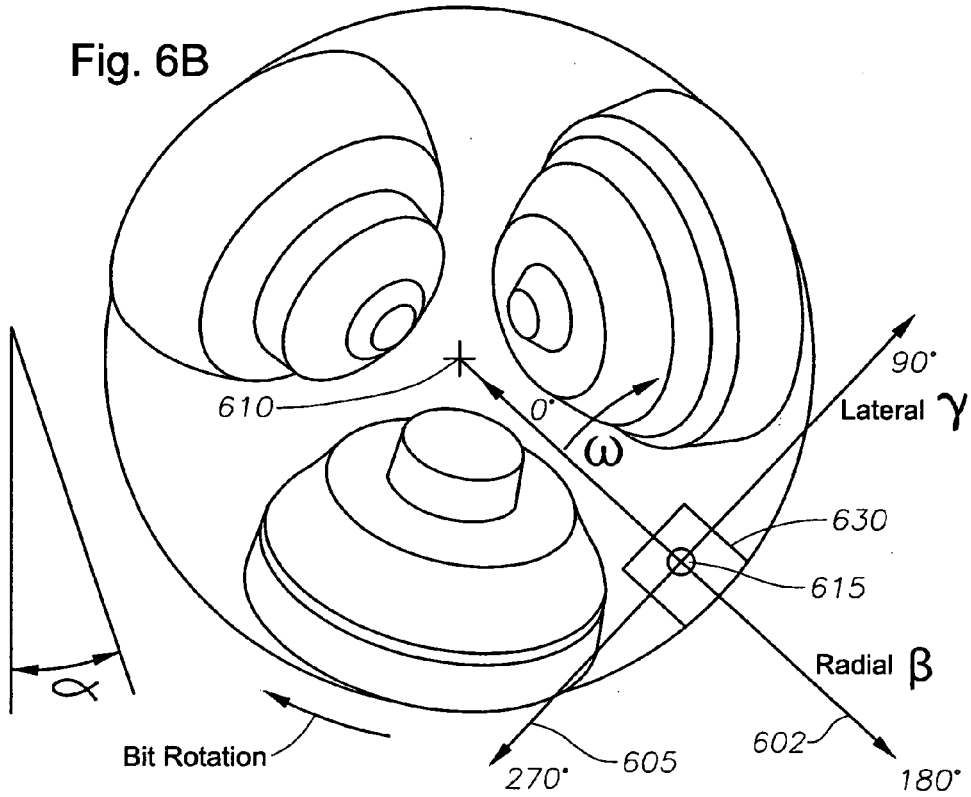

A three cone rock bit preferably includes three nozzles installed in three nozzle receptacles. For a "standard" nozzle or standard mini-extended nozzle or for another nozzle with a straight bore that ejects fluid along the nozzle centerline, angular offset may conveniently be defined prior to nozzle installation and with regard to the nozzle receptacle. One aspect of the invention is therefore the angles for nozzle receptacles located on the face of the drill bit body. Referring to FIG. 6B, a top-down reference diagram is shown that defines the angular offset of a nozzle or nozzle receptacle. This diagram is not drawn to scale, but includes a drill bit 600 having three roller cones. Point 610 defines the centerline of drill bit 600, while point 615 defines the center of the nozzle receptacle at its exit. FIG. 6D shows the position of point 615 lying at the intersection of the receptacle centerline 617 and the exit surface of the nozzle receptacle 618. Referring back to FIG. 6A, a reference line parallel to the longitudinal axis of the drill bit runs through point 615. The radial reference line 602 defines the direction of the borehole wall directly away from the drill bit 600. The lateral reference line 605 is perpendicular to radial reference line 602. A lateral vector is positive when it points generally in the direction of bit rotation and generally toward the leading cone. Conversely, a lateral vector is negative when it points generally against the direction of bit rotation and toward the lagging cone. The invention includes projected fluid paths at both positive and negative lateral angles. The radial reference line intersects point 610 in the center of the drill bit 600, and intersects a lateral reference line at point 615. A radial vector is positive when it points outward, toward the borehole wall. A radial vector is negative when it points inward toward the bit centerline. Thus, each canting or direction of a projected fluid path may be defined as being some combination of a radial vector and a lateral vector.

Figure 6C:
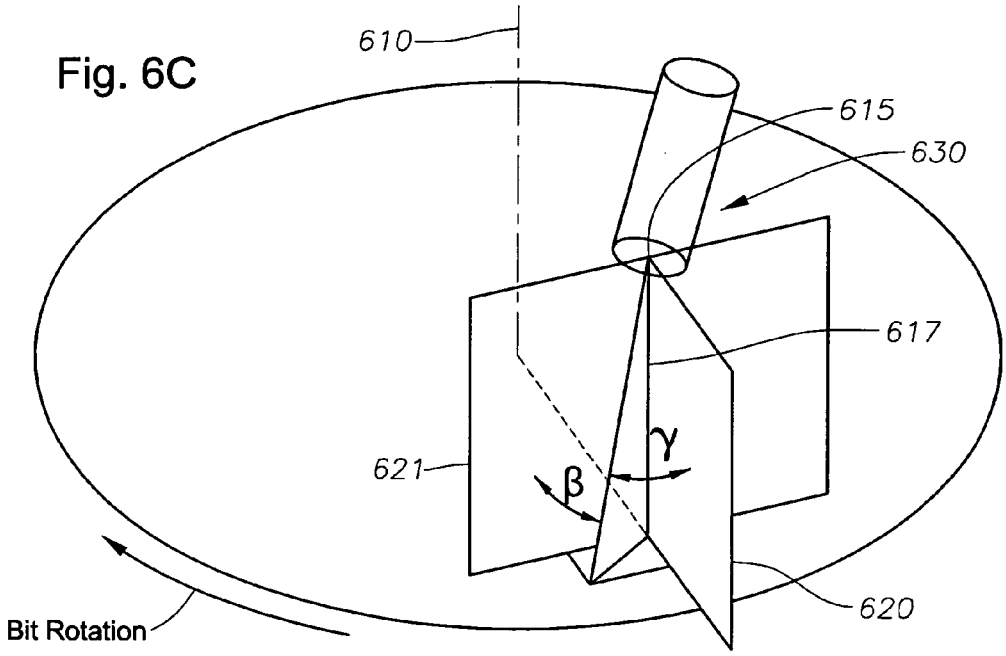
Figure 6D:
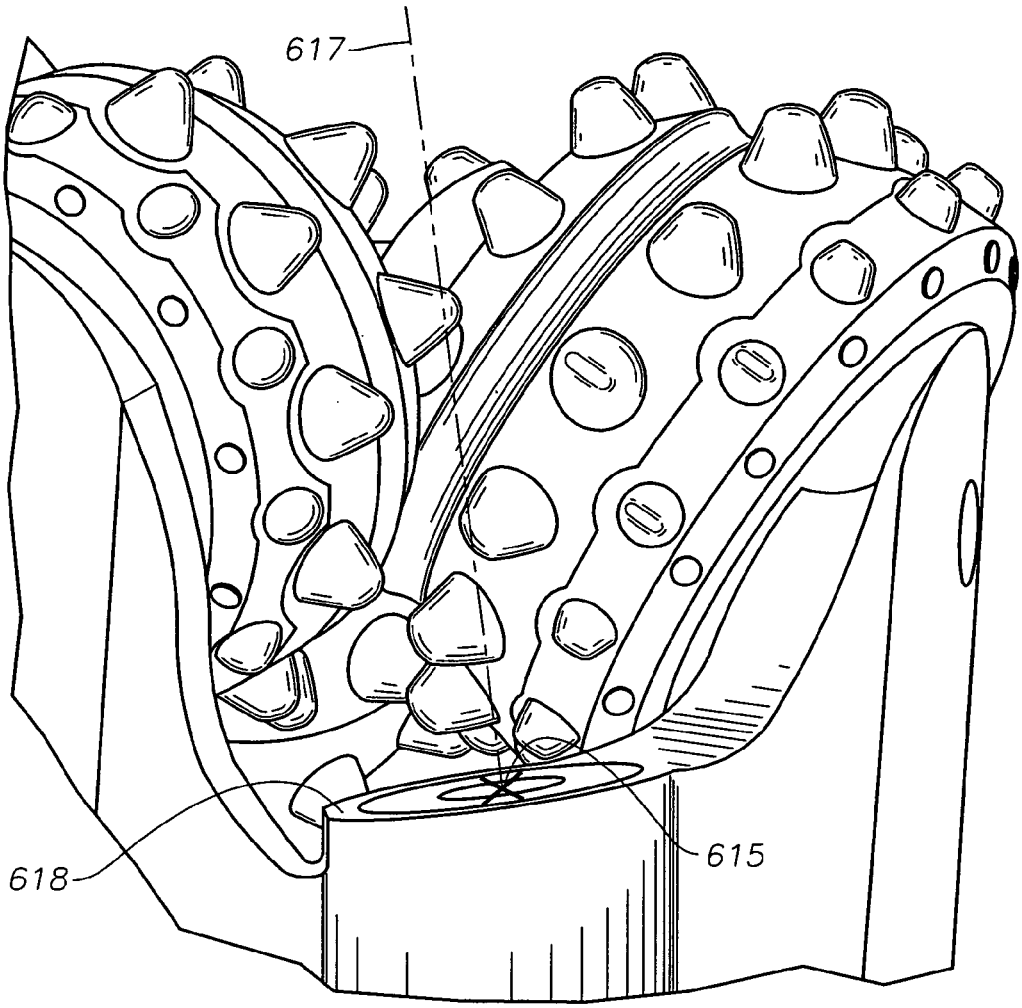
Figure 6E:
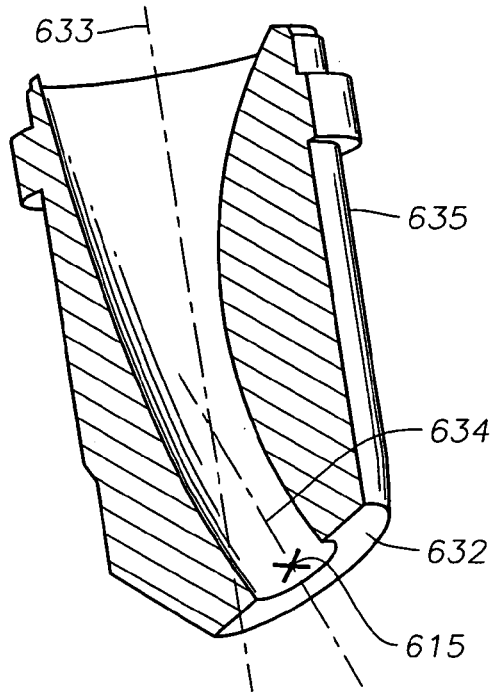

Describing points and planes of interest may be accomplished with respect to FIGS. 6B and 6E. In this case, point 615 defines a centroid of an exit surface for a nozzle. Point 615 and bit axis 610 define a radial plane. A second plane perpendicular to the first, the lateral plane, is defined by a translated line parallel to the bit centerline and running through the centroid point 615 of the nozzle exit. When nozzle body 635 is installed in the nozzle receptacle (not shown), nozzle axis 633 may be aligned with the axis of the nozzle receptacle. However, where the fluid changes direction as it moves through the nozzle, the fluid direction will exit from the nozzle in a direction generally aligned with exit bore axis 634. This is also perpendicular to the nozzle exit surface 632. A projected fluid path may then be calculated from the exit surface 632 of the nozzle in the same manner as is calculated from the nozzle receptacle, described above.

One example of this is shown in FIG. 6C. A nozzle receptacle 630 is shown in FIG. 6C, with the direction of its projected fluid path being defined by two vector angles, γ and β. The angle γ is a lateral angle defined with respect to a first plane 620. Plane 620 is formed by the bit centerline 610 and nozzle receptacle reference line 617. Nozzle reference line 617 is parallel to bit centerline 610 and travels through the point 615 located at the center of the nozzle receptacle exit surface. Positive γ angles direct the fluid in the direction of rotation of the bit while negative γ angles direct the fluid against the rotation of the bit. A γ angle of zero degrees directs the fluid within the radial reference plane 620.

The angle β is defined by a second plane 621 that lies perpendicular to the first plane 620 and that intersects the first plane at 617, the nozzle receptacle reference line. In other words, the radial angle β may be referenced from a side view of the nozzle. Positive β angles direct the fluid in the direction of the hole wall while negative β angles direct the fluid toward the center of the bit. A β angle of zero degrees directs the fluid within the lateral reference plane 621. When both the γ and β angles are zero degrees, the drilling fluid is directed parallel to the center line of the bit and generally normal to the hole bottom.

Figure 9:
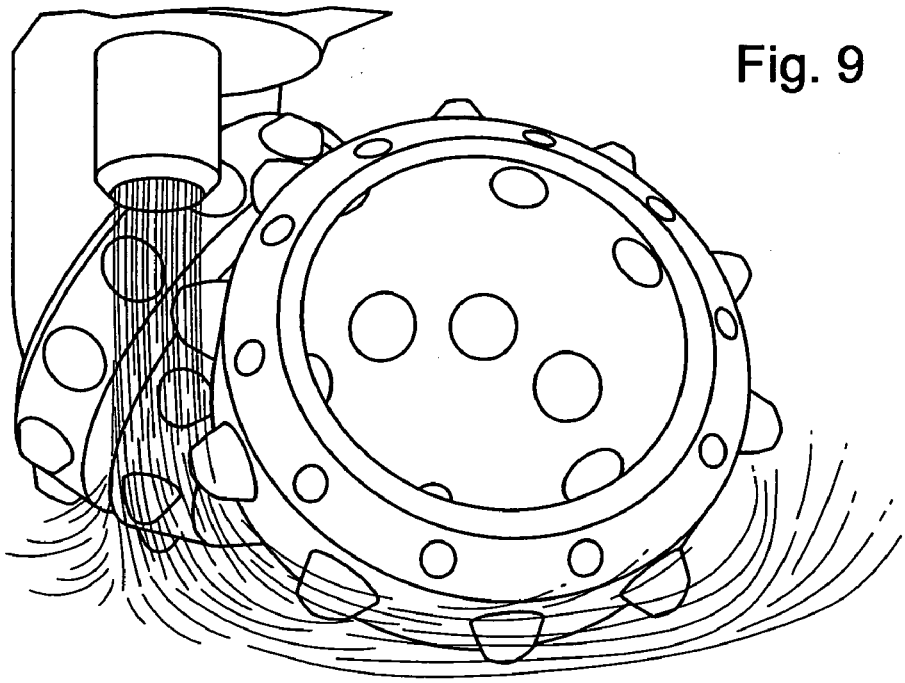
FIG. 9 shows a mini-extended nozzle.

In some embodiments, each cone cleaning nozzle is a mini-extended nozzle as shown in FIG. 9. Mini-extended nozzles have the advantage that they provide higher velocity fluid at the insert tip to maximize cone cleaning. In some formations, such as those with large amounts of abrasive particles such as sand, diffuser nozzles may be preferable. In a diffuser nozzle, the fluid is slowed down within the body of the nozzle such that when it exits the nozzle bore, the fluid has a wider flow stream with a lower velocity. This allows high velocity fluid (although with significantly less velocity than when an equivalent sized mini-extended nozzle is used) to move closer to the cutter tip but at a lower velocity which will minimize any cone shell erosion while maintaining cone cleaning. In addition, a central cone cleaning nozzle may be included in a drill bit built according to the invention.

Another embodiment of the invention is a drill bit designed so that each fluid column or projected fluid path that would otherwise be within 1.0 inches of an insert row-of-interest will be directed so that the projected fluid path comes within 0.3 inches of the row-of-interest. What results is a drill bit that has as many projected fluid paths as desired (but at least one) 0.3 inches or less away from the same insert or insert rows of interest on the various roller cones, and as many projected fluid paths as desired more than 1.0 inches away from the same insert or insert rows of interest on the various cones, but it does not have any fluid columns from 0.3 to 1.0 inches away from the row-of-interest or rows of interest (measured at their closest). Preferably, for improved cone cleaning, the distance will be less, such as 0.2 inches. Consequently, fluid columns that previously were not ideally positioned for cone cleaning are now moved close enough to the cone to be effective. Fluid columns further than 1.0 inches away from the cones, which may have had other purposes such as bottom hole cleaning, may still be included in the drill bit designed according to this aspect of the invention. Thus, the principles of the invention can be employed even where there is not a cone cleaning nozzle that corresponds to a single one of the cones.

Figure 10A:
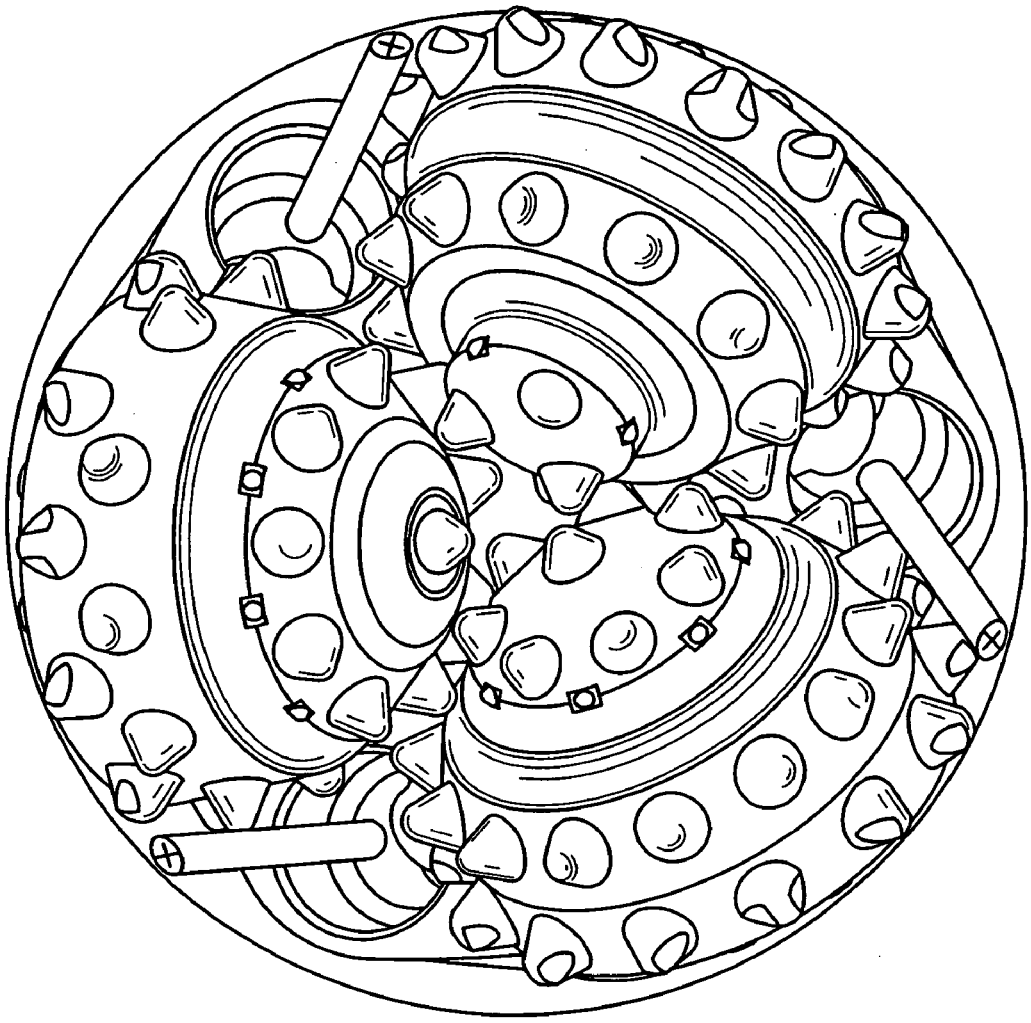
FIGS. 10A and 10B show preferred radial limits for projected fluid paths.
Figure 10B:
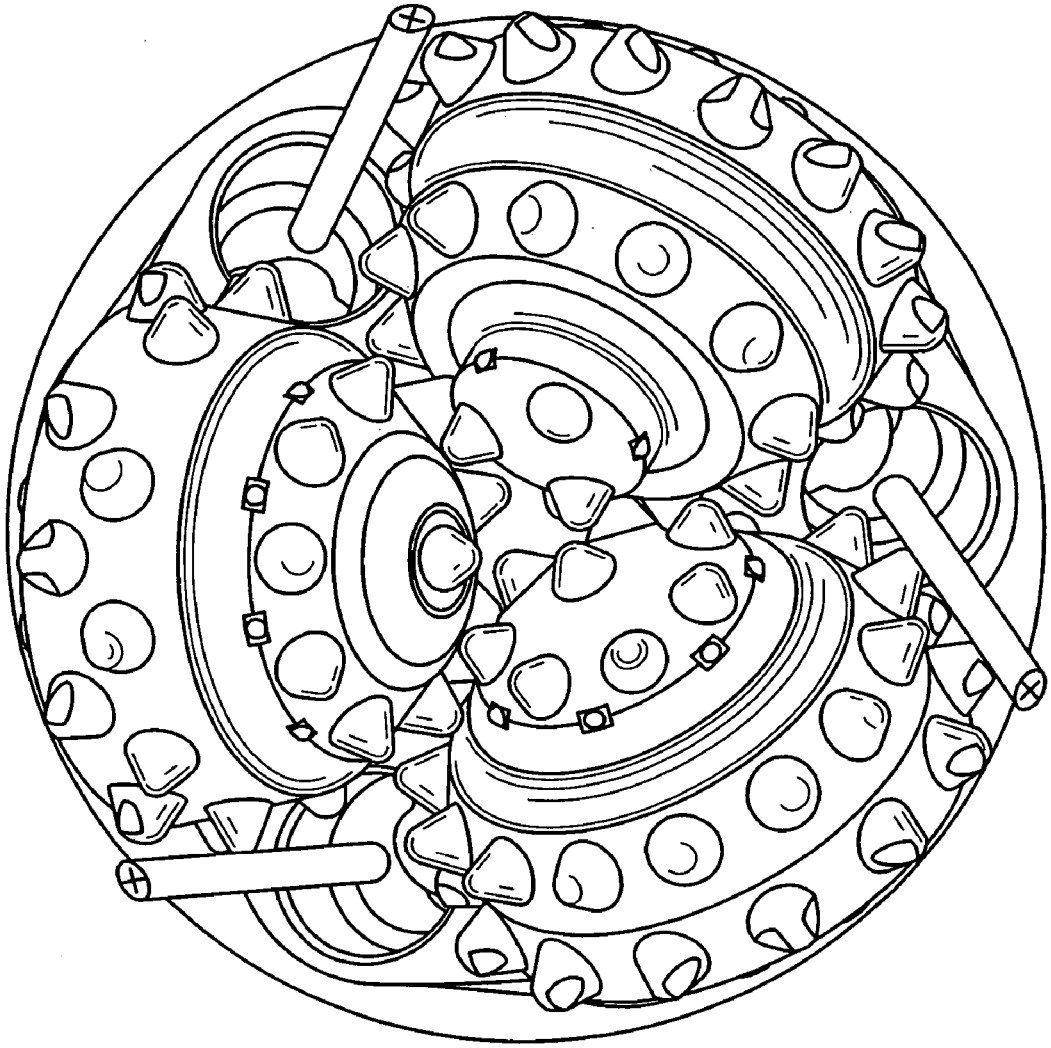

Referring to FIGS. 10A and 10B, the definition of a cone cleaning nozzle (or nozzle receptacle) may also be expressed in a manner that includes a radial impact or intersection location for each projected fluid path. It should be understood that the borehole bottom is curved rather than flat, and consequently the fluid jet impinges upon the hole bottom at a curved section. Preferably, the projected impingement location of the projected fluid path is to be within the radial distance of where the innermost drive row (the inner row next to the gage row) among the cones scrapes the bottom hole and the location where the gage row scrapes the bottom hole (which is curved). FIG. 10A, is a perspective from the bottom of the drill bit. With respect to a plane perpendicular to the central axis of the drill bit that intersects the bottom most point cut by the drill bit, the location of impingement for one embodiment would be within the bit radius, i.e. the projected radial distance of the impingement location of the nozzle stream centerline from the bit axis is to be within around 55% to around 100% of the bit radius at the bottom hole. Referring now to the alternate embodiment of FIG. 10B, the location of impingement relative to a plane perpendicular to the central axis of the drill bit that intersects the bottom most point cut by the drill bit, the projected impingement location of the fluid jet on this bottom plane is to be from around 60% to around 120% of the bit radius (outside the bit radius).

The principles of the invention may be particularly suited to larger drill bits, where the distances between bit components tends naturally to be greater, all other things being equal. Thus, the invention may be particularly suited to drill bits of 5⅞ inches and larger, and even more suited to drill bits of 7⅞ inches and larger. For a drill bit of 7⅞ inches and larger, the maximum distance on each of the cones between the cone cleaning fluid columns and the insert curve line should be 0.4 inches or less. For a drill bit of 5⅞ inches and larger up to 7⅞ inches, the maximum distance on each of the cones between the cone cleaning fluid columns and the insert curve line should be 0.3 inches or less.

While preferred embodiments of this invention have been shown and described, modifications thereof can be made by one skilled in the art without departing from the spirit or teaching of this invention. The embodiments described herein are exemplary only and are not limiting. Many variations and modifications of the system and apparatus are possible and are within the scope of the invention. Accordingly, the scope of protection is not limited to the embodiments described herein, but is only limited by the claims which follow, the scope of which shall include all equivalents of the subject matter of the claims.

What is claimed is:

1. A drill bit comprising:

a bit body with a bit central axis, and that defines a gage diameter;

a first roller cone, attached to said bit body, rotatable around a first journal axis;

a first row of cutting elements attached to said first roller cone that includes a first cutting element, said first cutting element having a first cutting tip;

a first cutting tip curve defined by rotating first roller cone with attached first cutting tip around said first journal axis;

a first nozzle receptacle in said bit body that defines a first projected fluid path, said first nozzle receptacle being located from 25% to 100% of the distance between said central axis and said gage diameter;

said first projected fluid path being within 0.4 inches of said first cutting tip curve;

a second roller cone, attached to said bit body, rotatable around a second journal axis;

a second row of cutting elements attached to said second roller cone that includes a second cutting element, said second cutting element having a second cutting tip;

a second cutting tip curve defined by rotating second roller cone with attached second cutting tip wound said second journal axis;

a second nozzle receptacle in said bit body that defines a second projected fluid path;

said second projected fluid path being within 0.4 inches of said second cutting tip curve;

a first distance from said first nozzle receptacle to said bit central axis;

a second distance from said second nozzle receptacle to said bit central axis;

a first angle between said first journal axis and said first nozzle receptacle;

a second angle between said second journal axis and said second nozzle receptacle;

wherein at least one is selected from the group consisting of:

said first distance differs from said second distance; and said first angle differs from said second angle.

2. The drill bit of claim 1, said drill bit having a diameter of at least seven and seven-eighths inches.

3. The drill bit of claim 2, said first projected fluid path being within 0.3 inches of said first cutting tip curve and said second projected fluid path being within 0.3 inches of said second cutting tip curve.

4. The drill bit of claim 3, wherein said drill bit defines a gage diameter, said first row of cutting elements is a gage row that cuts to about said gage diameter, and said second row of cutting elements is a gage row that cuts to about said gage diameter.

5. The drill bit of claim 3, further comprising:

a third row of cutting elements attached to said first roller cone;

a fourth row of cutting elements attached to said second roller cone;

wherein said drill bit defines a gage diameter, said third row of cutting elements being a gage row that cuts to about said gage diameter;

said fourth row of cutting elements being a gage row that cuts to about said gage diameter;

said first row of cutting elements being a drive row that does not cut to said about said gage diameter; and said second row of cutting elements being a drive row that does not cut to about said gage diameter.

6. The drill bit of claim 5, said first projected fluid path being between said first and third rows at its closest to said first cutting tip curve and said second projected fluid path being between said second and fourth rows at its closest to said second cutting tip curve.

7. The drill bit of claim 3, further comprising:

a third row of cutting elements on said first roller cone;

a fourth row of cutting elements on said second roller cone;

said first row being a gage row and said second row being a gage row;

said third row being a drive row and said fourth row being a drive row;

the shortest distance between said first row and said third row being different from the shortest distance between said second row and said fourth row.

8. The drill bit of claim 3, said drill bit having a bottom and defining a cutting plane at said bottom, and a bit radius, said drill bit further comprising:

a radial angle for said first projected fluid path such that said first projected fluid path intersects said cutting plane at a location fern 55 percent to 100 percent of said bit radius.

9. The drill bit of claim 8, said drill bit further comprising:

a radial angle for said second projected fluid path such that said second projected fluid path intersects said cutting plane at a location from 55 percent to 100 percent of said bit radius.

10. The drill bit of claim 3, said drill bit having a bit radius, a bottom, and defining a cutting plane perpendicular to said bit central axis at the lowermost point of said bottom, said drill bit further comprising:

a radial angle for said first projected fluid path such that said first projected fluid path intersects said cutting plane at a location from 60 percent to 120 percent of said bit radius.

11. The drill bit of claim 10, said drill bit further comprising:

a radial angle for said second projected fluid path such that said second projected fluid path intersects said cutting plane at a location from 60 percent to 120 percent of said bit radius.

12. The drill bit of claim 3, wherein both said first distance differs from said second distance, and said first angle differs from said second angle.

13. The drill bit of claim 2, further comprising:

a first nozzle, installed in said first nozzle receptacle, that defines a third projected fluid path collinear with said first projected fluid path; and a second nozzle, installed in said second nozzle receptacle, that defines a fourth projected fluid path collinear with said second projected fluid path.

14. The drill bit of claim 13, said third projected fluid path being a face normal projected fluid path.

15. The drill bit of claim 13, said third projected fluid path being a parallel to nozzle centerline projected fluid path.

16. The drill bit of claim 13, said third projected fluid path being a projected average fluid path.

17. The drill bit of claim 13, further comprising:

a third roller cone, attached to said bit body, rotatable around a third journal axis;

a third row of cutting elements attached to said third roller cone that includes a third cutting element, said third cutting element having a third cutting tip; and a third nozzle receptacle in said bit body that defines a fifth projected fluid path;

a third nozzle, installed in said third nozzle receptacle, that defines a sixth projected fluid path collinear with said fifth projected fluid path; and said fifth and sixth projected fluid paths being within 0.4 inches of said third cutting tip curve.

18. The drill bit of claim 3, further comprising:

a first nozzle, installed in said first nozzle receptacle, that defines a third projected fluid path collinear with said first projected fluid path; and a second nozzle, installed in said second nozzle receptacle, that defines a fourth projected fluid path collinear with said second projected fluid path.

19. The drill bit of claim 18, said third projected fluid path being a face normal projected fluid path.

20. The drill bit of claim 18, said third projected fluid path being a parallel to nozzle centerline projected fluid path.

21. The drill bit of claim 18, said third projected fluid path being a projected average fluid path.

22. The drill bit of claim 18, further comprising:

a third roller cone, attached to said bit body, rotatable around a third journal axis;

a third row of cutting elements attached to said third roller cone that includes a third cutting element, said third cutting element having a third cutting tip; and a third nozzle receptacle in said bit body that defines a fifth projected fluid path;

a third nozzle, installed in said third nozzle receptacle, that defines a sixth projected fluid path collinear with said fifth projected fluid path; and said fifth and sixth projected fluid pats being within 0.3 inches of said third cutting tip curve.

23. The drill bit of claim 3, further comprising:

a first nozzle with a straight internal bore, installed in said first nozzle receptacle; and a second nozzle with a straight internal bore, installed in said second nozzle receptacle.

24. The drill bit of claim 2, said first projected fluid path being within 0.2 inches of said first cutting tip curve and said second projected fluid path being within 0.2 inches of said second cutting tip curve.

25. The drill bit of claim 24, wherein said drill bit defines a gage diameter, said first row of cutting elements is a gage row that cuts to about said gage diameter, and said second row of cutting elements is a gage row that cuts to about said gage diameter.

26. The drill bit of claim 24, further comprising:

a third row of cutting elements attached to said first roller cone;

a fourth row of cutting elements attached to said second roller cone;

wherein said drill bit defines a gage diameter, said third row of cutting elements being a gage row that cuts to about said gage diameter;

said fourth row of cutting elements being a gage row that cuts to about said gage diameter;

said first row of cutting elements being a drive row that does not cut to said about said gage diameter; and said second row of cutting elements being a drive row that does not cut to about said gage diameter.

27. The drill bit of claim 26, said first projected fluid path being between said first and third rows at its closest to said first cutting tip curve and said second projected fluid path being between said second and fourth rows at its closest to said second cutting tip curve.

28. The drill bit of claim 24, further comprising:

a third row of cutting elements on said first roller cone;

a fourth row of cutting elements on said second roller cone;

said first row being a gage row and said second row being a gage row;

said third row being a drive row and said fourth row being a drive row;

the shortest distance between said first row and said third row being different from the shortest distance between said second row and said fourth row.

29. The drill bit of claim 24, said drill bit having a bottom and defining a cutting plane at said bottom, and a bit radius, said drill bit further comprising:

a radial angle for said first projected fluid path such that said first projected fluid path intersects said cutting plane at a location from 55 percent to 100 percent of said bit radius.

30. The drill bit of claim 29, said drill bit further comprising:

a radial angle for said second projected fluid path such that said second projected fluid path intersects said cutting plane at a location from 55 percent to 100 percent of said bit radius.

31. The drill bit of claim 24, said drill bit having a bit radius, a bottom, and defining a cutting plane perpendicular to said bit central axis at the lowermost point of said bottom, said drill bit further comprising:

a radial angle for said first projected fluid path such that said first projected fluid path intersects said cutting plane at a location from 60 percent to 120 percent of said bit radius.

32. The drill bit of claim 31, said drill bit further comprising:

a radial angle for said second projected fluid path such that said second projected fluid path intersects said cutting plane at a location from 60 percent to 120 percent of said bit radius.

33. The drill bit of claim 24, wherein both said first distance differs from said second distance, and said first angle differs from said second angle.

34. The drill bit of claim 24, further comprising:

a first nozzle, installed in said first nozzle receptacle, that defines a third projected fluid path collinear with said first projected fluid path; and a second nozzle, installed in said second nozzle receptacle, that defines a fourth projected fluid path collinear with said second projected fluid path.

35. The drill bit of claim 34, said third projected fluid path being a face normal projected fluid path.

36. The drill bit of claim 34, said third projected fluid path being a parallel to nozzle centerline projected fluid path.

37. The drill bit of claim 34, said third projected fluid path being a projected average fluid path.

38. The drill bit of claim 34, further comprising:

a third roller cone, attached to said bit body, rotatable around a third journal axis;

a third row of cutting elements attached to said third roller cone that includes a third cutting element said thud cutting element having a third cutting tip; and a third nozzle receptacle in said bit body that defines a fifth projected fluid path;

a third nozzle, installed in said third nozzle receptacle, that defines a sixth projected fluid path collinear with said fifth projected fluid path; and said fifth and sixth projected fluid paths being within 0.2 inches of said third cutting tip curve.

39. The drill bit of claim 24, further comprising:

a first nozzle with a straight internal bore, installed in said first nozzle receptacle; and a second nozzle with a straight internal bore, installed in said second nozzle receptacle.

40. The drill bit of claim 2, further comprising:

a third row of cutting elements attached to said first roller cone;

a fourth row of cutting elements attached to said second roller cone;

wherein said drill bit defines a gage diameter, said third row of cutting elements being a gage row that cuts to about said gage diameter;

said fourth row of cutting elements being a gage row that cuts to about said gage diameter;

said first row of cutting elements being a drive row that does not cut to said about said gage diameter; and said second row of cutting elements being a drive row that does not cut to about said gage diameter.

41. The drill bit of claim 40, said first projected fluid path being between said first and third lows at its closest to said first cutting tip curve and said second projected fluid path being between said second and fourth rows at its closest to said second cutting tip curve.

42. The drill bit of claim 2, further comprising:

a third roller cone, attached to said bit body, rotatable around a third journal axis;

a third row of cutting elements attached to said third roller cone that includes a third cutting element, said third cutting element having a third cutting tip; and a third cutting tip curve defined by rotating said third roller cone with attached third cutting tip around said third journal axis;

a third nozzle receptacle in said bit body that defines a third projected fluid path;

said third projected fluid path being within 0.4 inches of said third cutting tip curve.

43. The drill bit of claim 2, further comprising:

a third roller cone, attached to said bit body, rotatable around a third journal axis;

a third row of cutting elements attached to said third roller cone that includes a third cutting element, said third cutting element having a third cutting tip; and a third cutting tip curve defined by rotating said third roller cone with attached third cutting tip around said third journal axis;

a third nozzle receptacle in said bit body that defines a third projected fluid path;

said third projected fluid path being within 0.3 inches of said third cutting tip curve.

44. The drill bit of claim 2, further comprising:

a third roller cone, attached to said bit body, rotatable around a third journal axis;

a third row of cutting elements attached to said third roller cone that includes a third cutting element, said third cutting element having a third cutting tip; and a third cutting tip curve defined by rotating said third roller cone with attached third cutting tip around said third journal axis;

a third nozzle receptacle in said bit body that defines a third projected fluid path;

said third projected fluid path being within 0.2 inches of said third cutting tip curve.

45. The drill bit of claim 2, further comprising:

a third row of cutting elements on said first roller cone;

a fourth row of cutting elements on said second roller cone;

said first row being a gage row and said second row being a gage row;

said third row being a drive row and said fourth row being a drive row;

the shortest distance between said first row and said third row being different from the shortest distance between said second row and said fourth row.

46. The drill bit of claim 2, said drill bit having a bit radius, a bottom, and defining a cutting plane at perpendicular to said bit central axis the lowermost point of said bottom, said drill bit further comprising:

a radial angle for said first projected fluid path such that said first projected fluid path intersects said cutting plane at a location from 55 percent to 100 percent of said bit radius.

47. The drill bit of claim 2, said drill bit having a bottom and defining a cutting plane at said bottom, and a bit radius, said drill bit further comprising:

a radial angle for said first projected fluid path such that said first projected fluid path intersects said cutting plane at a location from 60 percent to 120 percent of said bit radius.

48. The drill bit of claim 47, said drill bit further comprising:

a radial angle for said second projected fluid path such that said second projected fluid path intersects said cutting plane at a location from 60 percent to 120 percent of said bit radius.

49. The drill bit of claim 2, wherein both said first distance differs from said second distance, and said first angle differs from said second angle.

50. The drill bit of claim 2, further comprising:

a first nozzle with a straight internal bore, installed in said first nozzle receptacle; and a second nozzle with a straight internal bore, installed in said second nozzle receptacle.

51. The drill bit of claim 2, said first row of cutting elements being the same relative row number, counting from a gage row on said first roller cone, as said second row of cutting elements, counting from a gage row on said second roller cone.

52. The drill bit of claim 51, said first projected fluid path being within 0.3 inches of said first cutting tip curve and said second projected fluid path being within 0.3 inches of said second cutting tip curve.

53. The drill bit of claim 51, said first projected fluid path being within 0.2 inches of said first cutting tip curve and said second projected fluid path being within 0.2 inches of said second cutting tip curve.

54. The drill bit of claim 2, further comprising:

a third roller cone, attached to said bit body, rotatable around a third journal axis;

a third row of cutting elements attached to said third roller cone that includes a third cutting element, said third cutting element having a third cutting tip; and a third cutting tip curve defined by rotating said third roller cone with attached third cutting tip around said third journal axis;

a third nozzle receptacle in said bit body that defines a third projected fluid path;

wherein said drill bit defines a gage diameter, said first row of cutting elements being a gage row that cuts to about said gage diameter;

said second row of cutting elements being a gage row that cuts to about said gage diameter;

said third row of cutting elements being a gage row that cuts to about said gage diameter;

wherein said first projected fluid path is within 0.2 inches of said first cutting tip curve, said second projected fluid path is within 0.2 inches of said second cutting tip curve; and said third projected fluid path is within 0.2 inches of said third cutting tip curve.

55. The drill bit of claim 2, further comprising:

a third roller cone, attached to said bit body, rotatable around a third journal axis;

a third row of cutting elements attached to said third roller cone that includes a third cutting element, said third cutting element having a third cutting tip; and a third cutting tip curve defined by rotating said third roller cone with attached third cutting tip around said third journal axis;

a third nozzle receptacle in said bit body that defines a third projected fluid path;

wherein said drill bit defines a gage diameter;

said first row of cutting elements being a gage row that cuts to about said gage diameter;

said second row of cutting elements being a gage row that cuts to about said gage diameter;

said third row of cutting elements being a gage row that cuts to about said gage diameter;

wherein said first projected fluid path is within 0.3 inches of said first cutting tip curve, said second projected fluid path is within 0.3 inches of said second cutting tip curve; and said third projected fluid path is within 0.3 inches of said third cutting tip curve.

56. The drill bit of claim 2, further comprising:

a third roller cone, attached to said bit body, rotatable around a third journal axis;

a third row of cutting elements attached to said third roller cone that includes a third cutting element, said third cutting element having a third cutting tip; and a third cutting tip curve defined by rotating said third roller cone with attached third cutting tip around said third journal axis;

a third nozzle receptacle in said bit body that defines a third projected fluid path;

said first row of cutting elements being the same relative row number, counting from a gage row on said first roller cone, as said second row of cutting elements, counting from a gage row on said second roller cone, and said third row of cutting elements, counting from a gage row on said third roller cone.

57. The drill bit of claim 56, said first projected fluid path being within 0.3 inches of said first cutting tip curve, said second projected fluid path being within 0.3 inches of said second cutting tip curve, and said third projected fluid path being within 0.3 inches of said third cutting tip curve.

58. The drill bit of claim 56, said first projected fluid path being within 0.2 inches of said first cutting tip curve, said second projected fluid path being within 0.2 inches of said second cutting tip curve, and said third projected fluid path being within 0.2 inches of said third cutting tip curve.

59. The drill bit of claim 2, wherein every non-central nozzle receptacle on said drill bit body defines a projected fluid path and every cutting element on a roller cone defines a cutting tip curve, every projected fluid pat from a non-central nozzle receptacle being within 0.4 inches of a cutting tip curve.

60. The drill bit of claim 2, wherein every non-central nozzle receptacle on said drill bit body defines a projected fluid path and every cutting element on a roller cone defines a cutting tip curve, every projected fluid path from a non-central nozzle receptacle being within 0.3 inches of a cutting tip curve.

61. The drill bit of claim 2, wherein every non-central nozzle receptacle on said drill bit body defines a projected fluid path and every cutting element on a roller cone defines a cutting tip curve, every projected fluid path from a non-central nozzle receptacle being within 0.2 inches of a cutting tip curve.

62. The drill bit of claim 1, said drill bit having a diameter of at least five and seven eighths inch diameter but less than seven and seven eighths inch diameter, said first projected fluid path being within 0.3 inches of said first cutting tip curve and said second projected fluid path being within 0.3 inches of said second cutting tip curve.

63. The drill bit of claim 62, wherein said drill bit defines a gage diameter, said first row of cutting elements is a gage row that cuts to about said gage diameter, and said second row of cutting elements is a gage row that cuts to about said gage diameter.

64. The drill bit of claim 62, further comprising:

a third row of cutting elements attached to said first roller cone;

a fourth row of cutting elements attached to said second roller cone;

wherein said drill bit defines a gage diameter, said third row of cutting elements being a gage row that cuts to about said gage diameter;

said fourth row of cutting elements being a gage row that cuts to about said gage diameter;

said first row of cutting elements being a drive row that does not cut to said about said gage diameter; and said second row of cutting elements being a drive row that does not cut to about said gage diameter.

65. The drill bit of claim 64, said first projected fluid path being between said first and third rows at its closest to said first cutting tip curve and said second projected fluid path being between said second and fourth rows at its closest to said second cutting tip curve.

66. The drill bit of claim 62, further comprising:

a third roller cone, attached to said bit body, rotatable around a third journal axis;

a third row of cutting elements attached to said third roller cone that includes a third cutting element, said third cutting element having a third cutting tip; and a third cutting tip curve defined by rotating said third roller cone with attached third cutting tip around said third journal axis;

a third nozzle receptacle in said bit body that defines a third projected fluid path;

said third projected fluid path being within 0.3 inches of said third cutting tip curve.

67. The drill bit of claim 62, further comprising:

a third row of cutting elements on said first roller cone;

a fourth row of cutting elements on said second roller cone;

said first row being a gage row and said second row being a gage row;

said third row being a drive row and said fourth row being a drive row;

the shortest distance between said first row and said third row being different from the shortest distance between said second row and said fourth row.

68. The drill bit of claim 62, said drill bit having a bit radius, a bottom, and defining a cutting plane perpendicular to said bit central axis at the lowermost point of said bottom, said drill bit further comprising:

a radial angle for said first projected fluid path such that said first projected fluid path intersects said cutting plane at a location from 55 percent to 100 percent of said bit radius.

69. The drill bit of claim 62, said drill bit further comprising:

a radial angle for said second projected fluid path such that said second projected fluid path intersects said cutting plane at a location from 55 percent to 100 percent of said bit radius.

70. The drill bit of claim 62, said drill bit having a bit radius, a bottom, and defining a cutting plane perpendicular to said bit central axis at the lowermost point of said bottom, said drill bit further comprising:

a radial angle for said first projected fluid path such that said first projected fluid path intersects said cutting plane at a location from 60 percent to 120 percent of said bit radius.

71. The drill bit of claim 62, wherein both said first distance differs from said second distance, and said first angle differs from said second angle.

72. The drill bit of claim 62, further comprising:

a first nozzle, installed in said first nozzle receptacle, that defines a third projected fluid path collinear with said first projected fluid path; and a second nozzle, installed in said second nozzle receptacle, that defines a fourth projected fluid path collinear with said second projected fluid path.

73. The drill bit of claim 72, said third projected fluid path being a face normal projected fluid path.

74. The drill bit of claim 72, said third projected fluid path being a parallel to nozzle centerline projected fluid path.

75. The drill bit of claim 72, said third projected fluid path being a projected average fluid path.

76. The drill bit of claim 72, further comprising:

a third roller cone, attached to said bit body, rotatable around a third journal axis;

a third row of cutting elements attached to said third roller cone that includes a third cutting element, said third cutting element having a third cutting tip; and a third nozzle receptacle in said bit body that defines a fifth projected fluid path;

a third nozzle, installed in said third nozzle receptacle, that defines a sixth projected fluid path collinear with said fifth projected fluid path; and said fifth and sixth projected fluid paths being within 0.3 inches of said third cutting tip curve.

77. The drill bit of claim 62, further comprising:

a first nozzle with a straight internal bore, installed in said first nozzle receptacle; and a second nozzle with a straight internal bore, installed in said second nozzle receptacle.

78. The drill bit of claim 62, said first row of cutting elements being the same relative row number, counting from a gage row on said first roller cone, as said second row of cutting elements, counting from a gage row on said second roller cone.

79. The drill bit of claim 62, further comprising:

a third roller cone, attached to said bit body, rotatable around a third journal axis;

a third row of cutting elements attached to said third roller cone that includes a third cutting element, said third cutting element having a third cutting tip; and a third cutting tip curve defined by rotating said third roller cone with attached third cutting tip around said third journal axis;

a third nozzle receptacle in said bit body that defines a third projected fluid path;

wherein said drill bit defines a gage diameter, said first row of cutting elements being a gage row that cuts to about said gage diameter;

said second row of cutting elements being a gage row that cuts to about said gage diameter;

said third row of cutting elements being a gage row that cuts to about said gage diameter;

wherein said first projected fluid path is within 0.3 inches of said first cutting tip curve, said second projected fluid path is within 0.3 inches of said second cutting tip curve; and said third projected fluid path is within 0.3 inches of said third cutting tip curve.

80. The drill bit of claim 78, said first projected fluid path being within 0.3 inches of said first cutting tip curve, said second projected fluid path being within 0.3 inches of said second cutting tip curve, and said third projected fluid path being within 0.3 inches of said third cutting tip curve.

81. The drill bit of claim 62, further comprising:

a third roller cone, attached to said bit body, rotatable around a third journal axis;

a third row of cutting elements attached to said third roller cone that includes a third cutting element, said third cutting element having a third cutting tip; and a third cutting tip curve defined by rotating third roller cone with attached third cutting tip around said third journal axis;

a third nozzle receptacle in said bit body that defines a third projected fluid path, said third projected fluid path being within 0.3 inches of said third cutting tip curve;

said first row of cutting elements being the same relative row number, counting from a gage row on said first roller cone, as said second row of cutting elements, counting from a gage row on said second roller cone, and said third row of cutting elements, counting from a gage row on said third roller cone.

82. The drill bit of claim 62, further comprising:

a third roller cone, attached to said bit body, rotatable around a third journal axis;

a third row of cutting elements attached to said third roller cone that includes a third cutting element, said third cutting element having a third cutting tip; and a third cutting tip curve defined by rotating third roller cone with attached third cutting tip around said third journal axis;

a third nozzle receptacle in said bit body that defines a third projected fluid path, said third projected fluid path being within 0.2 inches of said third cutting tip curve;

said first row of cutting elements being the same relative row number, counting from a gage row on said first roller cone, as said second row of cutting elements, counting from a gage row on said second roller cone, and said third row of cutting elements, counting from a gage row on said third roller cone.

83. The drill bit of claim 62, wherein every non-central nozzle receptacle on said drill bit body defines a projected fluid path and every cutting element on a roller cone defines a cutting tip curve, every projected fluid path from a non-central nozzle receptacle being within 0.3 inches of a cutting tip curve.

84. The drill bit of claim 1, said drill bit having a diameter of at least five and seven eighths inch diameter but less than seven and seven eighths inch diameter, said first projected fluid path being within 0.2 inches of said first cutting tip curve and said second projected fluid path being within 0.2 inches of said second cutting tip curve.

85. The drill bit of claim 84, wherein said drill bit defines a gage diameter, said first row of cutting elements is a gage row that cuts to about said gage diameter, and said second row of cutting elements is a gage row that cuts to about said gage diameter.

86. The drill bit of claim 84, further comprising:

a third row of cutting elements attached to said first roller cone;

a fourth row of cutting elements attached to said second roller cone;

wherein said drill bit defines a gage diameter, said third row of cutting elements being a gage row that cuts to about said gage diameter;

said fourth row of cutting elements being a gage row that cuts to about said gage diameter;

said first row of cutting elements being a drive row that does not cut to said about said gage diameter; and said second row of cutting elements being a drive row that does not cut to about said gage diameter.

87. The drill bit of claim 86, said first projected fluid path being between said first and third rows at its closest to said first cutting tip curve and said second projected fluid path being between said second and fourth rows at its closest to said second cutting tip curve.

88. The drill bit of claim 84, further comprising:

a third roller cone, attached to said bit body, rotatable around a third journal axis;

a third row of cutting elements attached to said third roller cone that includes a third cutting element, said third cutting element having a third cutting tip; and a third cutting tip curve defined by rotating said third roller cone with attached third cutting tip around said third journal axis;

a third nozzle receptacle in said bit body that defines a third projected fluid path;

said third projected fluid path being within 0.2 inches of said third cutting tip curve.

89. The drill bit of claim 84, further comprising:

a third row of cutting elements on said first roller cone;

a fourth row of cutting elements on said second roller cone;

said first row being a gage row and said second row being a gage row;

said third row being a drive row and said fourth row being a drive row;

the shortest distance between said first row and said third row being different from the shortest distance between said second row and said fourth row.

90. The drill bit of claim 84, said drill bit having a bit radius, a bottom, and defining a cutting plane perpendicular to said bit central axis at the lowermost point of said bottom, said drill bit further comprising:

a radial angle for said first projected fluid path such that said first projected fluid path intersects said cutting plane at a location from 55 percent to 100 percent of said bit radius.

91. The drill bit of claim 84, said drill bit further comprising:

a radial angle for said second projected fluid path such that said second projected fluid path intersects said cutting plane at a location from 55 percent to 100 percent of said bit radius.

92. The drill bit of claim 84, said drill bit having a bit radius, a bottom, and defining a cutting plane perpendicular to said bit central axis at the lowermost point of said bottom, said drill bit further comprising:

a radial angle for said first projected fluid path such that said first projected fluid path intersects said cutting plane at a location from 60 percent to 120 percent of said bit radius.

93. The drill bit of claim 84, wherein both said first distance differs from said second distance, and said first angle differs from said second angle.

94. The drill bit of claim 84, further comprising:

a first nozzle, installed in said first nozzle receptacle, that defines a third projected fluid path collinear with said first projected fluid path; and a second nozzle, installed in said second nozzle receptacle, that defines a fourth projected fluid path collinear with said second projected fluid path.

95. The drill bit of claim 94, said third projected fluid path being a face normal projected fluid path.

96. The drill bit of claim 94, said third projected fluid path being a parallel to nozzle centerline projected fluid path.

97. The drill bit of claim 94, said third projected fluid path being a projected average fluid path.

98. The drill bit of claim 94, further comprising:

a third roller cone, attached to said bit body, rotatable around a third journal axis;

a third row of cutting elements attached to said third roller cone that includes a third cutting element, said third cutting element having a third cutting tip; and a third nozzle receptacle in said bit body that defines a fifth projected fluid path;

a third nozzle, installed in said third nozzle receptacle, that defines a sixth projected fluid path collinear with said fifth projected fluid path; and said fifth and sixth projected fluid paths being within 0.2 inches of said third cutting tip curve.

99. The drill bit of claim 84, further comprising:

a first nozzle with a straight internal bore, installed in said first nozzle receptacle; and a second nozzle with a straight internal bore, installed in said second nozzle receptacle.

100. The drill bit of claim 84, said first row of cutting elements being the same relative row number, counting from a gage row on said first roller cone, as said second row of cutting elements, counting from a gage row on said second roller cone.

101. The drill bit of claim 100, said first projected fluid path being within 0.2 inches of said first cutting tip curve, said second projected fluid path being within 0.2 inches of said second cutting tip curve, and said third projected fluid path being within 0.2 inches of said third cutting tip curve.

102. The drill bit of claim 84, further comprising:

a third roller cone, attached to said bit body, rotatable around a third journal axis;

a third row of cutting elements attached to said third roller cone that includes a third cutting element, said third cutting element having a third cutting tip; and a third cutting tip curve defined by rotating said third roller cone with attached third cutting tip around said third journal axis;

a third nozzle receptacle in said bit body that defines a third projected fluid path;

wherein said drill bit defines a gage diameter;

said first row of cutting elements being a gage row that cuts to about said gage diameter;

said second row of cutting elements being a gage row that cuts to about said gage diameter;

said third row of cutting elements being a gage row that cuts to about said gage diameter;

wherein said first projected fluid path is within 0.2 inches of said first cutting tip curve, said second projected fluid path is within 0.2 inches of said second cutting tip curve; and said third projected fluid path is within 0.2 inches of said third cutting tip curve.

103. The drill bit of claim 84, wherein every non-central nozzle receptacle on said drill bit body defines a projected fluid path and every cutting element on a roller cone defines a cutting tip curve, every projected fluid path from a non-central nozzle receptacle being within 0.2 inches of a cutting tip curve.

104. A drill bit comprising:

a bit body with a bit central axis, and defining a gage diameter;

a first roller cone with a first cone shell, attached to said bit body, rotatable around a first journal axis;

a first row of cutting elements attached to said first roller cone that includes a first cutting element, said first cutting element having a first cutting tip;

a first cutting tip curve defined by rotating first roller cone with attached first cutting tip around said first journal axis;

a first nozzle receptacle in said bit body;

a first nozzle, installed in said first nozzle receptacle, that defines a first projected fluid path and that forms a first centroid at an exit location, said centroid being located greater than 25% of the distance between said central axis and gage diameter from said central axis;

said first projected fluid path being within 0.4 inches of said first cutting tip curve;

a second roller cone with a second cone shell, attached to said bit body, rotatable mound a second journal axis;

a second row of cutting elements attached to said second roller cone that includes a second cutting element, said second cutting element having a second cutting tip;

a second cutting tip curve defined by rotating second roller cone with attached second cutting tip around said second journal axis;

a second nozzle receptacle in said bit body;

a second nozzle, installed in said second nozzle receptacle, that defines a second projected fluid path and that forms a second centroid at an exit location, said second centroid being located greater than 25% of the distance between said central axis and gage diameter from said central axis;

said second projected fluid path being within 0.4 inches of said second cutting tip curve;

a lateral angle for said first projected fluid path defined with respect to a first plane, said first plane being defined by said bit body central axis, and by a first line lying parallel to said bit body central axis and intersecting said first centroid;

a radial angle for said first projected fluid path defined with respect to a second plane, said second plane being perpendicular to said first plane and parallel to said central axis;

a lateral angle for said second projected fluid path defined with respect to a third plane, said third plane being defined by said bit body central axis, and by a second line lying parallel to said bit body central axis and intersecting said second centroid;

a radial angle for said second projected fluid path defined with respect to a fourth plane, said fourth plane being perpendicular to said third plane and parallel to said central axis;

wherein the lateral and radial angles of said first projected fluid path differ from said lateral and radial angles of said second projected fluid path such that the spatial relationship between said first projected fluid path and said first cone shell differs from the spatial relationship between said second projected fluid path and said second cone shell.

105. The drill bit of claim 104, said drill bit having a diameter of at least seven and seven eighth inches.

106. The drill bit of claim 105, said first projected fluid path being within 0.3 inches of said first cutting tip curve and said second projected fluid path being within 0.3 inches of said second cutting tip curve.

107. The drill bit of claim 106, further comprising:

a third row of cutting elements on said first roller cone;

a fourth row of cutting elements on said second roller cone;

said first row being a gage row and said second row being a gage row;

said third row being a drive row and said fourth row being a drive row;

the shortest distance between said first row and said third row being different from the shortest distance between said second row and said fourth row.

108. The drill bit of claim 106, said drill bit having a bit radius, a bottom, and defining a cutting plane perpendicular to said bit central axis at the lowermost point of said bottom, said drill bit further comprising:

a radial angle for said first projected fluid path such that said first projected fluid path intersects said cutting plane at a location from 55 percent to 100 percent of said bit radius.

109. The drill bit of claim 106, said drill bit having a bit radius, a bottom, and defining a cutting plane perpendicular to said bit central axis at the lowermost point of said bottom, said drill bit further comprising:

a radial angle for said first projected fluid path such that said first projected fluid path intersects said cutting plane at a location from 60 percent to 120 percent of said bit radius.

110. The drill bit of claim 106, said first projected fluid path being a face normal projected fluid path.

111. The drill bit of claim 106, said first projected fluid path being a parallel to nozzle centerline projected fluid path.

112. The drill bit of claim 106, said first projected fluid path being a projected average fluid path.

113. The drill bit of claim 106, further comprising:

said first nozzle having a straight internal bore; and said second nozzle having a straight internal bore.

114. The drill bit of claim 106, said drill bit having a diameter of at least five and seven eighths inch diameter but less than seven and seven eighths inch diameter, said first projected fluid path being within 0.3 inches of said first cutting tip curve and said second projected fluid path being within 0.3 inches of said second cutting tip curve.

115. The drill bit of claim 105, said first projected fluid path being within 0.2 inches of said first cutting tip curve and said second projected fluid path being within 0.2 inches of said second cutting tip curve.

116. The drill bit of claim 115, further comprising:

a third row of cutting elements attached to said first roller cone;

a fourth row of cutting elements attached to said second roller cone;

wherein said drill bit defines a gage diameter, said third row of cutting elements being a gage row that cuts to about said gage diameter;

said fourth row of cutting elements being a gage row that cuts to about said gage diameter;

said first row of cutting elements being a drive row that does not cut to said about said gage diameter; and said second row of cutting elements being a drive row that does not cut to about said gage diameter.

117. The drill bit of claim 116, said first projected fluid path being between said first and third rows at its closest to said first cutting tip curve and said second projected fluid path being between said second and fourth rows at its closest to said second cutting tip curve.

118. The drill bit of claim 107, further comprising:

a third row of cutting elements on said first roller cone;

a fourth row of cutting elements on said second roller cone;

said first row being a gage row and said second row being a gage row;

said third row being a drive row and said fourth row being a drive row;

the shortest distance between said first row and said third row being different from the shortest distance between said second row and said fourth row.

119. The drill bit of claim 115, said drill bit having a bit radius, a bottom, and defining a cutting plane perpendicular to said bit central axis at the lowermost point of said bottom, said drill bit further comprising:

a radial angle for said first projected fluid path such that said first projected fluid path intersects said cutting plane at a location from 55 percent to 100 percent of said bit radius.

120. The drill bit of claim 115, said drill bit having a bit radius, a bottom, and defining a cutting plane perpendicular to said bit central axis at the lowermost point of said bottom, said drill bit further comprising:

a radial angle for said first projected fluid path such that said first projected fluid path intersects said cutting plane at a location from 60 percent to 120 percent of said bit radius.

121. The drill bit of claim 115, said first projected fluid path being a face normal projected fluid path.

122. The drill bit of claim 115, said first projected fluid path being a parallel to nozzle centerline projected fluid path.

123. The drill bit of claim 115, said first projected fluid path being a projected average fluid path.

124. The drill bit of claim 115, further comprising:

said first nozzle having a straight internal bore; and said second nozzle having a straight internal bore.

125. The drill bit of claim 106, wherein every nozzle receptacle on said drill bit body defines a projected fluid path and every cutting element on a roller cone defines a cutting tip curve, every projected fluid path being within 0.3 inches of a cutting tip curve.

126. The drill bit of claim 115, wherein every nozzle receptacle on said drill bit body defines a projected fluid path and every cutting element on a roller cone defines a cutting tip curve, every projected fluid path being within 0.2 inches of a cutting tip curve.

127. The drill bit of claim 115, said drill bit having a diameter of at least five and seven eighths inch diameter but less than seven and seven eighths inch diameter, said first projected fluid path being within 0.2 inches of said first cutting tip curve and said second projected fluid path being within 0.2 inches of said second cutting tip curve.

128. The drill bit of claim 105, further comprising:

a third roller cone, attached to said bit body, rotatable around a third journal axis;

a third row of cutting elements attached to said third roller cone that includes a third cutting element, said third cutting element having a cutting tip; and a third nozzle receptacle in said bit body that defines a third projected fluid path;

said third projected fluid path being within 0.4 inches of said third cutting tip curve.

129. The drill bit of claim 128, wherein said drill bit defines a gage diameter, said first row of cutting elements is a gage row that cuts to about said gage diameter, and said second row of cutting elements is a gage row that cuts to about said gage diameter, and said third row of cutting elements is a gage row that cuts to about said gage diameter.

130. The drill bit of claim 105, further comprising:

a third row of cutting elements attached to said first roller cone;

a fourth row of cutting elements attached to said second roller cone;

wherein said drill bit defines a gage diameter, said third row of cutting elements being a gage row that cuts to about said gage diameter;

said fourth row of cutting elements being a gage row that cuts to about said gage diameter;

said first row of cutting elements being a drive row that does not cut to said about said gage diameter; and said second row of cutting elements being a drive row that does not cut to about said gage diameter.

131. The drill bit of claim 130, said first projected fluid path being between said first and third rows at its closest to said first cutting tip curve and said second projected fluid path being between said second and fourth rows at its closest to said second cutting tip curve.

132. The drill bit of claim 105, further comprising:

a third roller cone, attached to said bit body, rotatable around a third journal axis;

a third row of cutting elements attached to said third roller cone that includes a third cutting element, said third cutting element having a third cutting tip; and a third cutting tip curve defined by rotating said third roller cone with attached third cutting tip around said third journal axis;

a third nozzle receptacle in said bit body that defines a third projected fluid path;

said third projected fluid path being within 0.3 inches of said third cutting tip curve.

133. The drill bit of claim 105, further comprising:

a third roller cone, attached to said bit body, rotatable around a third journal axis;

a third row of cutting elements attached to said third roller cone that includes a third cutting element, said third cutting element having a third cutting tip; and a third cutting tip curve defined by rotating said third roller cone with attached third cutting tip around said third journal axis;

a third nozzle receptacle in said bit body that defines a third projected fluid path;

said third projected fluid path being within 0.2 inches of said third cutting tip curve.

134. The drill bit of claim 105, further comprising:

a third row of cutting elements on said first roller cone;

a fourth row of cutting elements on said second roller cone;

said first row being a gage row and said second row being a gage row;

said third row being a drive row and said fourth row being a drive row;

the shortest distance between said first row and said third row being different from the shortest distance between said second row and said fourth row.

135. The drill bit of claim 105, said drill bit having a bit radius, a bottom, and defining a cutting plane perpendicular to said bit central axis at the lowermost point of said bottom, said drill bit farther comprising:

a radial angle for said first projected fluid path such that said first projected fluid path intersects said cutting plane at a location from 55 percent to 100 percent of said bit radius.

136. The drill bit of claim 105, said drill bit having a bit radius, a bottom, and defining a cutting plane perpendicular to said bit central axis at the lowermost point of said bottom, said drill bit further comprising:

a radial angle for said first projected fluid path such that said first projected fluid path intersects said cutting plane at a location from 60 percent to 120 percent of said bit radius.

137. The drill bit of claim 105, said first projected fluid path being a face normal projected fluid path.

138. The drill bit of claim 105, said first projected fluid path being a parallel to nozzle centerline projected fluid path.

139. The drill bit of claim 105, said first projected fluid path being a projected average fluid path.

140. The drill bit of claim 105, further comprising:

a third roller cone, attached to said bit body, rotatable around a third journal axis;

a third row of cutting elements attached to said third roller cone that includes a third cutting element, said third cutting element having a third cutting tip; and a third nozzle receptacle in said bit body;

a third nozzle, installed in said third nozzle receptacle, that defines a third projected fluid path collinear with said fifth projected fluid path; and said third projected fluid paths being within 0.4 inches of said third cutting tip curve.

141. The drill bit of claim 105, further comprising:

said first nozzle having a straight internal bore; and said second nozzle having a straight internal bore.

142. The drill bit of claim 105, said first row of cutting elements being the same relative row number, counting from a gage row on said first roller cone, as said second row of cutting elements, counting from a gage row on said second roller cone.

143. The drill bit of claim 142, said first projected fluid path being within 0.3 inches of said first cutting tip curve and said second projected fluid path being within 0.3 inches of said second cutting tip curve.

144. The drill bit of claim 142, said first projected fluid path being within 0.2 inches of said first cutting tip curve and said second projected fluid path being within 0.2 inches of said second cutting tip curve.

145. The drill bit of claim 105, further comprising:

a third roller cone, attached to said bit body, rotatable around a third journal axis;

a third row of cutting elements attached to said third roller cone that includes a third cutting element, said third cutting element having a third cutting tip; and a third cutting tip curve defined by rotating said third roller cone with attached third cutting tip around said third journal axis;

a third nozzle receptacle in said bit body that defines a third projected fluid path;

wherein said drill bit defines a gage diameter, said first row of cutting elements being a gage row that cuts to about said gage diameter;

said second row of cutting elements being a gage row that cuts to about said gage diameter;

said third row of cutting elements being a gage row that cuts to about said gage diameter;

wherein said first projected fluid path is within 0.2 inches of said first cutting tip curve, said second projected fluid path is within 0.2 inches of said second cutting tip curve; and said third projected fluid path is within 0.2 inches of said third cutting tip curve.

146. The drill bit of claim 105, further comprising:

a third roller cone, attached to said bit body, rotatable around a third journal axis;

a third row of cutting elements attached to said third roller cone that includes a third cutting element, said third cutting element having a third cutting tip; and a third cutting tip curve defined by rotating said third roller cone with attached third cutting tip around said third journal axis;

a third nozzle receptacle in said bit body that defines a third projected fluid path;

wherein said drill bit defines a gage diameter, said first row of cutting elements being a gage row that cuts to about said gage diameter;

said second row of cutting elements being a gage row that cuts to about said gage diameter;

said third row of cutting elements being a gage row that cuts to about said gage diameter;

wherein said first projected fluid path is within 0.3 inches of said first cutting tip curve, said second projected fluid path is within 0.3 inches of said second cutting tip curve; and said third projected fluid path is within 0.3 inches of said third cutting tip curve.

147. The drill bit of claim 105, further comprising:

a third roller cone, attached to said bit body, rotatable around a third journal axis;

a third row of cutting elements attached to said third roller cone that includes a third cutting element, said third cutting element having a third cutting tip; and a third cutting tip curve defined by rotating said third roller cone with attached third cutting tip around said third journal axis;

a third nozzle receptacle in said bit body that defines a third projected fluid path, said third projected fluid path being within 0.4 inches of said third cutting tip curve;

said first row of cutting elements being the same relative row number, counting from a gage row on said first roller cone, as said second row of cutting elements, counting from a gage row on said second roller cone, and said third row of cutting elements, counting from a gage row on said third roller cone.

148. The drill bit of claim 147, said first projected fluid path being within 0.3 inches of said first cutting tip curve, said second projected fluid path being within 0.3 inches of said second cutting tip curve, and said third projected fluid path being within 0.3 inches of said third cutting tip curve.

149. The drill bit of claim 147, said first projected fluid path being within 0.2 inches of said first cutting tip curve, said second projected fluid path being within 0.2 inches of said second cutting tip curve, and said third projected fluid path being within 0.2 inches of said third cutting tip curve.

150. The drill bit of claim 105, wherein every nozzle receptacle on said drill bit body defines a projected fluid path and every cutting element on a roller cone defines a cutting tip curve, every projected fluid path being within 0.4 inches of a cutting tip curve.

151. A rolling cone rock bit, comprising:

a bit body having a diameter of at least five and seven-eighth inches, with a bit central axis and defining a gage diameter;

a first roller cone with a first cone shell, attached to said bit body, rotatable around a first journal axis;

a first row of cutting elements attached to said first roller cone that includes a first cutting element, said first cutting element having a first cutting tip, said first row of cutting elements being a gage row that cuts to about said gage diameter;

a first cutting tip curve defined by said first cutting tip when rotated around said first journal axis;

a first nozzle receptacle in said bit body;

a first nozzle, installed in said first nozzle receptacle, that defines a first projected fluid path and that forms a first centroid at an exit location;

said first projected fluid path being within 0.3 inches of said first cutting tip curve;

a second roller cone with a second cone shell, attached to said bit body, rotatable around a second journal axis;

a second row of cutting elements attached to said second roller cone that includes a second cutting element, said second cutting element having a second cutting tip, said second row of cutting elements being a gage row that cuts to about said gage diameter;

a second cutting tip curve defined by rotating second roller cone with attached second cutting tip around said second journal axis;

a second nozzle receptacle in said bit body;

a second nozzle, installed in said second nozzle receptacle, that defines a second projected fluid path and that forms a second centroid at an exit location;

a third roller cone with a third cone shell, attached to said bit body, rotatable around a third journal axis;

a third row of cutting elements attached to said third roller cone that includes a third cutting element, said third cutting element having a third cutting tip, said third row of cutting elements being a gage row that cuts to about said gage diameter;

a third cutting tip curve defined by said third cutting tip when rotated around said third journal axis;

a third nozzle receptacle in said bit body;

a third nozzle, installed in said third nozzle receptacle, that defines a third projected fluid path and that forms a third centroid at an exit location; and wherein every projected fluid path within 1.0 inches of said first cutting tip curve at closest is also within 0.3 inches of said first cutting tip curve;

wherein every projected fluid path within 1.0 inches of said second cutting tip curve at closest is also within 0.3 inches of said second cutting tip curve; and wherein every projected fluid path within 1.0 inches of said third cutting tip curve at closest is also within 0.3 inches of said third cutting tip curve.

152. The drill bit of claim 151, wherein said first, second, and third nozzle receptacles located greater than one-quarter of the way between said bit central axis and said gage diameter.

153. The drill bit of claim 151, wherein said first projected fluid path is within 0.2 inches of said first cutting tip curve;

wherein every projected fluid path that is within 1.0 inches of said first cutting tip curve at closest is also within 0.2 inches of said first cutting tip curve;

wherein every projected fluid path that is within 1 .0 inches of said second cutting tip curve at closest is also within 0.2 inches of said second cutting tip curve; and wherein every projected fluid path that is within 1.0 inches of said third cutting tip curve at closest is also within 0.2 inches of said third cutting tip curve.

154. The rolling cone rock bit of claim 153, each of said projected fluid paths being face normal projected fluid paths.

155. The rolling cone rock bit of claim 153, each of said projected fluid paths being parallel to nozzle centerline projected fluid paths.

156. The rolling cone rock bit of claim 153, each of said projected fluid paths being a projected average fluid path.

157. The rolling cone rock bit of claim 151, each of said projected fluid paths being face normal projected fluid paths.

158. The rolling cone rock bit of claim 151, each of said projected fluid paths being parallel to nozzle centerline projected fluid paths.

159. The rolling cone rock bit of claim 151, each of said projected fluid paths being a projected average fluid path.

160. A drill bit comprising:

a bit body with a bit central axis, and defining a gage diameter;

a first roller cone with a first cone shell, attached to said bit body, rotatable around a first journal axis;

a first row of cutting elements attached to said first roller cone that includes a first cutting element, said first cutting element having a first cutting tip;

a first cutting tip curve defined by rotating first roller cone with attached first cutting tip around said first journal axis;

a first nozzle receptacle in said bit body;

a first nozzle, installed in said first nozzle receptacle, that defines a first projected fluid path not parallel to said bit central axis and that forms a first centroid at an exit location, said centroid being located greater than 25% of the distance between said central axis and gage diameter from said central axis;

said first projected fluid path being within 0.4 inches of said first cutting tip curve;

a second roller cone with a second cone shell, attached to said bit body, rotatable around a second journal axis;

a second row of cutting elements attached to said second roller cone that includes a second cutting element, said second cutting element having a second cutting tip;

a second cutting tip curve defined by rotating second roller cone with attached second cutting tip around said second journal axis;

a second nozzle receptacle in said bit body;

a second nozzle, installed in said second nozzle receptacle, that defines a second projected fluid path not parallel to said bit central axis and that forms a second centroid at an exit location, said second centroid being located greater than 25% of the distance between said central axis and gage diameter from said central axis;

said second projected fluid path being within 0.4 inches of said second cutting tip curve;

a lateral angle for said first projected fluid path defined with respect to a first plane, said first plane being defined by said bit body central axis, and by a first line lying parallel to said bit body central axis and intersecting said first centroid;

a radial angle for said first projected fluid path defined with respect to a second plane, said second plane being perpendicular to said first plane and parallel to said central axis;

a lateral angle for said second projected fluid path defined with respect to a third plane, said third plane being defined by said bit body central axis, and by a second line lying parallel to said bit body central axis and intersecting said second centroid;

a radial angle for said second projected fluid path defined with respect to a fourth plane, said fourth plane being perpendicular to said third plane and parallel to said central axis;

a reference plane perpendicular to said bit central axis;

wherein at least one is selected from the group consisting of:

a different distance from said first exit location to said reference plane than from said second exit location to said reference plane;

said lateral angle of said first projected fluid path differs from said lateral angle of said second projected fluid path; and the radial angle of said first projected fluid path differs from said radial angle of said second projected fluid path.

161. The drill bit of claim 160, said drill bit having a diameter of at least seven and seven eighth inches.

162. The drill bit of claim 161, said first projected fluid path being within 0.3 inches of said first cutting tip curve and said second projected fluid path being within 0.3 inches of said second cutting tip curve.

163. The drill bit of claim 161, said first projected fluid path being within 0.2 inches of said first cutting tip curve and said second projected fluid path being within 0.2 inches of said second cutting tip curve.

164. The drill bit of claim 161, further comprising:

a third roller cone, attached to said bit body, rotatable around a third journal axis;

a third row of cutting elements attached to said third roller cone that includes a third cutting element, said third cutting element having a cutting tip; and a third nozzle receptacle in said bit body that defines a third projected fluid path;

said third projected fluid path being within 0.4 inches of said third cutting tip curve.

165. The drill bit of claim 164, wherein said drill bit defines a gage diameter, said first row of cutting elements is a gage row that cuts to about said gage diameter, and said second row of cutting elements is a gage row that cuts to about said gage diameter, and said third row of cutting elements is a gage row that cuts to about said gage diameter.

166. The drill bit of claim 161, wherein said distance differs from said first exit location to said reference plane than from said second exit location to said reference plane, said lateral angle of said first projected fluid path differs from said lateral angle of said second projected fluid path, and the radial angle of said first projected fluid path differs from said radial angle of said second projected fluid path.

* * * * *